US005818419A

United States Patent [19]

Tajima et al.

[11] Patent Number: 5,818,419

[45] Date of Patent: Oct. 6, 1998

[54] DISPLAY DEVICE AND METHOD FOR DRIVING THE SAME

[75] Inventors: Masaya Tajima; Toshio Ueda; Hirohito Kuriyama; Katsuhiro Ishida; Akira Yamamoto, all of Kawasaki, Japan

[73] Assignee: Fujitsu Limited, Kawasasi, Japan

[21] Appl. No.: 654,261

[22] Filed: May 28, 1996

[30] Foreign Application Priority Data

Oct. 31, 1995 [JP] Japan ..... 7-282972
Oct. 31, 1995 [JP] Japan ..... 7-282973

[51] Int. Cl.[6] ..... G09G 5/10

[52] U.S. Cl. ..... 345/147; 345/148; 345/63; 345/213

[58] Field of Search ..... 345/60, 63, 68, 345/87, 89, 77, 147, 148, 149, 99, 213, 212

[56] References Cited

U.S. PATENT DOCUMENTS 5,400,044 3/1995 Thomas ..... 345/89

FOREIGN PATENT DOCUMENTS 0 462 541 12/1991 European Pat. Off. .
0 579 359 1/1994 European Pat. Off. .
0 674 303 9/1995 European Pat. Off. .
0 707 302 4/1996 European Pat. Off. .

*Primary Examiner*—Xiao Wu
*Attorney, Agent, or Firm*—Staas & Halsey

[57] ABSTRACT

A display device, for displaying a multiple-level gray scale picture through a frame having a plurality of sub-frames which are time-divided in accordance with weight value of gray scale for each sub-frame, comprises sub-frame selection circuit, being supplied with an vertical synchronization signal, for selecting the number of the sub-frames which can be displayed within the period for the single frame in accordance with the frequency of the vertical synchronization signal, and for providing a sub-frame selection signal corresponding to the number of the sub-frames; and display control circuit, operatively connected to the sub-frame selection circuit, for receiving the sub-frame selection signal and an input display data signal and for controlling said display of the multi-level gray scale picture in accordance with the selected number of the sub-frames. When the frequency of Vsync. is varied, the optimal number of the subframes are selected so that a number of sustain pulse, conversion table for pseudo-multiple-level gray scale conversion and for duplicated subframe conversion are properly selected.

25 Claims, 33 Drawing Sheets

FIG. 3

| FREQUENCY [Hz] | SF (=k) | SEL | SF COUNT SET VALUE |
|---|---|---|---|
| $0 < fF \leqq 55$ | 8 | 7 | 0 |
| $55 < fF \leqq 65$ | 7 | 6 | 1 |
| $65 < fF \leqq 75$ | 6 | 5 | 2 |
| $75 < fF \leqq 85$ | 5 | 4 | 3 |
| $85 < fF \leqq 105$ | 4 | 3 | 4 |
| $105 < fF \leqq 140$ | 3 | 2 | 5 |
| $140 < fF \leqq 210$ | 2 | 1 | 6 |
| $210 < fF \leqq 420$ | 1 | 0 | 7 |

FIG. 9A

TABLE 1 DEC1

| SEL | | | ENA | | | | | | | SF |
|---|---|---|---|---|---|---|---|---|---|---|
| 2 | 1 | 0 | 6 | 5 | 4 | 3 | 2 | 1 | 0 | |
| L | L | L | L | L | L | L | L | L | L | 1 |
| L | L | H | H | L | L | L | L | L | L | 2 |
| L | H | L | H | H | L | L | L | L | L | 3 |
| L | H | H | H | H | H | L | L | L | L | 4 |
| H | L | L | H | H | H | H | L | L | L | 5 |
| H | L | H | H | H | H | H | H | L | L | 6 |
| H | H | L | H | H | H | H | H | H | L | 7 |
| H | H | H | H | H | H | H | H | H | H | 8 |

FIG. 9B

TABLE 2 DEC2

| SEL | | | ENB | | | | | | | | SF |
|---|---|---|---|---|---|---|---|---|---|---|---|
| 2 | 1 | 0 | 7 | 6 | 5 | 4 | 3 | 2 | 1 | 0 | |
| L | L | L | H | L | L | L | L | L | L | L | 1 |
| L | L | H | L | H | L | L | L | L | L | L | 2 |
| L | H | L | L | L | L | L | L | L | L | L | 3 |
| L | H | H | L | L | L | H | L | L | L | L | 4 |
| H | L | L | L | L | L | L | H | L | L | L | 5 |
| H | L | H | L | L | L | L | L | H | L | L | 6 |
| H | H | L | L | L | L | L | L | L | H | L | 7 |
| H | H | H | L | L | L | L | L | L | L | H | 8 |

FIG. 9C

TABLE 3 FOR 440

| SEL | | | Y | | | | | | |
|---|---|---|---|---|---|---|---|---|---|
| 2 | 1 | 0 | 6 | 5 | 4 | 3 | 2 | 1 | 0 |
| L | L | L | D6 | D5 | D4 | D3 | D2 | D1 | D0 |
| L | L | H | D5 | D4 | D3 | D2 | D1 | D0 | L |
| L | H | L | D4 | D3 | D2 | D1 | D0 | L | L |
| L | H | H | D3 | D2 | D1 | D0 | L | L | L |
| H | L | L | D2 | D1 | D0 | L | L | L | L |
| H | L | H | D1 | D0 | L | L | L | L | L |
| H | H | L | D0 | L | L | L | L | L | L |
| H | H | H | L | L | L | L | L | L | L |

FIG. 11

| LEVEL | ORDER OF SUB-FRAMES | | | | | | | |
|---|---|---|---|---|---|---|---|---|
| | 8 (1) | 16 (1) | 2 | 8 (3) | 4 | 1 | 16 (2) | 8 (2) |
| 0 | | | | | | | | |
| 1 | | | | | | ○ | | |
| 2 | | | ○ | | | | | |
| 3 | | | ○ | | | ○ | | |
| 4 | | | | | ○ | | | |
| 5 | | | | | ○ | ○ | | |
| 6 | | | ○ | | ○ | | | |
| 7 | | | ○ | | ○ | ○ | | |
| 8 | | | | ○ | | | | |
| 9 | | | | ○ | | ○ | | |
| 10 | | | ○ | ○ | | | | |
| 11 | | | ○ | ○ | | ○ | | |
| 12 | | | | ○ | ○ | | | |
| 13 | | | | ○ | ○ | ○ | | |
| 14 | | | ○ | ○ | ○ | | | |
| 15 | | | ○ | ○ | ○ | ○ | | |
| 16 | ○ | | | ○ | | | | |
| 17 | ○ | | | ○ | | ○ | | |
| 18 | ○ | | ○ | ○ | | | | |
| 19 | ○ | | ○ | ○ | | ○ | | |
| 20 | ○ | | | ○ | ○ | | | |
| 21 | ○ | | | ○ | ○ | ○ | | |
| 22 | ○ | | ○ | ○ | ○ | | | |
| 23 | ○ | | ○ | ○ | ○ | ○ | | |
| 24 | ○ | | | ○ | | | | ○ |
| 25 | ○ | | | ○ | | ○ | | ○ |
| 26 | ○ | | ○ | ○ | | | | ○ |
| 27 | ○ | | ○ | ○ | | ○ | | ○ |
| 28 | ○ | | | ○ | ○ | | | ○ |
| 29 | ○ | | | ○ | ○ | ○ | | ○ |
| 30 | ○ | | ○ | ○ | ○ | | | ○ |
| 31 | ○ | | ○ | ○ | ○ | ○ | | ○ |

| LEVEL | ORDER OF SUB-FRAMES | | | | | | | |
|---|---|---|---|---|---|---|---|---|
| | 8 (1) | 16 (1) | 2 | 8 (3) | 4 | 1 | 16 (2) | 8 (2) |
| 32 | | ○ | | ○ | | | | ○ |
| 33 | | ○ | | ○ | | ○ | | ○ |
| 34 | | ○ | ○ | ○ | | | | ○ |
| 35 | | ○ | ○ | ○ | | ○ | | ○ |
| 36 | | ○ | | ○ | ○ | | | ○ |
| 37 | | ○ | | ○ | ○ | ○ | | ○ |
| 38 | | ○ | ○ | ○ | ○ | | | ○ |
| 39 | | ○ | ○ | ○ | ○ | ○ | | ○ |
| 40 | | ○ | | ○ | | | ○ | |
| 41 | | ○ | | ○ | | ○ | ○ | |
| 42 | | ○ | ○ | ○ | | | ○ | |
| 43 | | ○ | ○ | ○ | | ○ | ○ | |
| 44 | | ○ | | ○ | ○ | | ○ | |
| 45 | | ○ | | ○ | ○ | ○ | ○ | |
| 46 | | ○ | ○ | ○ | ○ | | ○ | |
| 47 | | ○ | ○ | ○ | ○ | ○ | ○ | |
| 48 | ○ | ○ | | ○ | | | ○ | |
| 49 | ○ | ○ | | ○ | | ○ | ○ | |
| 50 | ○ | ○ | ○ | ○ | | | ○ | |
| 51 | ○ | ○ | ○ | ○ | | ○ | ○ | |
| 52 | ○ | ○ | | ○ | ○ | | ○ | |
| 53 | ○ | ○ | | ○ | ○ | ○ | ○ | |
| 54 | ○ | ○ | ○ | ○ | ○ | | ○ | |
| 55 | ○ | ○ | ○ | ○ | ○ | ○ | ○ | |
| 56 | ○ | ○ | | ○ | | | ○ | ○ |
| 57 | ○ | ○ | | ○ | | ○ | ○ | ○ |
| 58 | ○ | ○ | ○ | ○ | | | ○ | ○ |
| 59 | ○ | ○ | ○ | ○ | | ○ | ○ | ○ |
| 60 | ○ | ○ | | ○ | ○ | | ○ | ○ |
| 61 | ○ | ○ | | ○ | ○ | ○ | ○ | ○ |
| 62 | ○ | ○ | ○ | ○ | ○ | | ○ | ○ |
| 63 | ○ | ○ | ○ | ○ | ○ | ○ | ○ | ○ |

(FIRST MODE)

DT: 6bits
Q : 8bits
SUB-FRAME NO. 8

FIG. 12

| LEVEL | ORDER OF SUB-FRAMES | | | | | | |
|---|---|---|---|---|---|---|---|
| | 4 (1) | 8 (1) | 2 | 16 | 1 | 8 (2) | 4 (2) |
| 0 | | | | | | | |
| 1 | | | | | ○ | | |
| 2 | | | ○ | | | | |
| 3 | | | ○ | | ○ | | |
| 4 | ○ | | | | | | |
| 5 | ○ | | | | ○ | | |
| 6 | ○ | | ○ | | | | |
| 7 | ○ | | ○ | | ○ | | |
| 8 | ○ | | | | | | ○ |
| 9 | ○ | | | | ○ | | ○ |
| 10 | ○ | | ○ | | | | ○ |
| 11 | ○ | | ○ | | | | ○ |
| 12 | | ○ | | | | | ○ |
| 13 | | ○ | | | ○ | | ○ |
| 14 | | ○ | ○ | | | | ○ |
| 15 | | ○ | ○ | | ○ | | ○ |
| 16 | | ○ | | | | ○ | |
| 17 | | ○ | | | ○ | ○ | |
| 18 | | ○ | ○ | | | ○ | |
| 19 | | ○ | ○ | | ○ | ○ | |
| 20 | ○ | ○ | | | | ○ | |
| 21 | ○ | ○ | | | ○ | ○ | |

| LEVEL | ORDER OF SUB-FRAMES | | | | | | |
|---|---|---|---|---|---|---|---|
| | 4 (1) | 8 (1) | 2 | 16 | 1 | 8 (2) | 4 (2) |
| 22 | ○ | ○ | ○ | | | ○ | |
| 23 | ○ | ○ | ○ | | ○ | ○ | |
| 24 | | ○ | | ○ | | | |
| 25 | | ○ | | ○ | ○ | | |
| 26 | | ○ | | ○ | | | |
| 27 | | ○ | | ○ | ○ | | |
| 28 | | ○ | ○ | ○ | | | ○ |
| 29 | | ○ | ○ | ○ | ○ | | ○ |
| 30 | | ○ | ○ | ○ | | | ○ |
| 31 | | ○ | ○ | ○ | ○ | | ○ |
| 32 | | ○ | | ○ | | ○ | |
| 33 | | ○ | | ○ | ○ | ○ | |
| 34 | | ○ | ○ | ○ | | ○ | |
| 35 | | ○ | ○ | ○ | ○ | ○ | |
| 36 | ○ | ○ | | ○ | | ○ | |
| 37 | ○ | ○ | | ○ | ○ | ○ | |
| 38 | ○ | ○ | ○ | ○ | | ○ | |
| 39 | ○ | ○ | ○ | ○ | ○ | ○ | |
| 40 | ○ | ○ | | ○ | | ○ | ○ |
| 41 | ○ | ○ | | ○ | ○ | ○ | ○ |
| 42 | ○ | ○ | ○ | ○ | | ○ | ○ |
| 43 | ○ | ○ | ○ | ○ | ○ | ○ | ○ |

(FIRST MODE)

DT :6bits
Q :7bits
SUB-FRAME NO. :7

○ SHOWS LIGHT-ON.

FIG. 13

| LEVEL | ORDER OF SUB-FRAMES | | | | | |
|---|---|---|---|---|---|---|
| | 4 (1) | 8 (1) | 2 | 1 | 8 (2) | 4 (2) |
| 0 | | | | | | |
| 1 | | | | ○ | | |
| 2 | | | ○ | | | |
| 3 | | | ○ | ○ | | |
| 4 | ○ | | | | | |
| 5 | ○ | | | ○ | | |
| 6 | ○ | | ○ | | | |
| 7 | ○ | | ○ | ○ | | |
| 8 | ○ | | | | | ○ |
| 9 | ○ | | | ○ | | ○ |
| 10 | ○ | | ○ | | | ○ |
| 11 | ○ | | ○ | ○ | | ○ |
| 12 | | ○ | | | | ○ |
| 13 | | ○ | | ○ | | ○ |
| 14 | | ○ | ○ | | | ○ |
| 15 | | ○ | ○ | ○ | | ○ |
| 16 | | ○ | | | ○ | |
| 17 | | ○ | | ○ | ○ | |
| 18 | | ○ | ○ | | ○ | |
| 19 | | ○ | ○ | ○ | ○ | |
| 20 | ○ | ○ | | | ○ | |
| 21 | ○ | ○ | | ○ | ○ | |
| 22 | ○ | ○ | ○ | | ○ | |
| 23 | ○ | ○ | ○ | ○ | ○ | |
| 24 | ○ | ○ | | | ○ | ○ |
| 25 | ○ | ○ | | ○ | ○ | ○ |
| 26 | ○ | ○ | ○ | | ○ | ○ |
| 27 | ○ | ○ | ○ | ○ | ○ | ○ |

(FIRST MODE)

DT :5bits
Q :6bits
SUB-FRAME NO. :6

FIG. 15

| | | | | | | LEVEL | ORDER OF SUB-FRAMES | | | | | | |
|---|---|---|---|---|---|---|---|---|---|---|---|---|---|
| | | | | | | | 4 (1) | 8 (1) | 2 | 16 | 1 | 8 (2) | 4 (2) |
| 0 | 0 | 0 | 0 | 0 | 0 | 0 | | | | | | | |
| 0 | 0 | 0 | 0 | 0 | 1 | 1 | | | | | ○ | | |
| 0 | 0 | 0 | 0 | 1 | 0 | 2 | | | ○ | | | | |
| 0 | 0 | 0 | 0 | 1 | 1 | 3 | | | ○ | | ○ | | |
| 0 | 0 | 0 | 1 | 0 | 0 | 4 | ○ | | | | | | |
| 0 | 0 | 0 | 1 | 0 | 1 | 5 | ○ | | | | ○ | | |
| 0 | 0 | 0 | 1 | 1 | 0 | 6 | ○ | | ○ | | | | |
| 0 | 0 | 0 | 1 | 1 | 1 | 7 | ○ | | ○ | | ○ | | |
| 0 | 0 | 1 | 0 | 0 | 0 | 8 | ○ | | | | | | ○ |
| 0 | 0 | 1 | 0 | 0 | 1 | 9 | ○ | | | | ○ | | ○ |
| 0 | 0 | 1 | 0 | 1 | 0 | 10 | ○ | | ○ | | | | ○ |
| 0 | 0 | 1 | 0 | 1 | 1 | 11 | ○ | | ○ | | | | ○ |
| 0 | 0 | 1 | 1 | 0 | 0 | 12 | | ○ | | | | | ○ |
| 0 | 0 | 1 | 1 | 0 | 1 | 13 | | ○ | | | ○ | | ○ |
| 0 | 0 | 1 | 1 | 1 | 0 | 14 | | ○ | ○ | | | | ○ |
| 0 | 0 | 1 | 1 | 1 | 1 | 15 | | ○ | ○ | | ○ | | ○ |
| 0 | 1 | 0 | 0 | 0 | 0 | 16 | | ○ | | | | ○ | |
| 0 | 1 | 0 | 0 | 0 | 1 | 17 | | ○ | | | ○ | ○ | |
| 0 | 1 | 0 | 0 | 1 | 0 | 18 | | ○ | ○ | | | ○ | |
| 0 | 1 | 0 | 0 | 1 | 1 | 19 | | ○ | ○ | | ○ | ○ | |
| 0 | 1 | 0 | 1 | 0 | 0 | 20 | ○ | ○ | | | | ○ | |
| 0 | 1 | 0 | 1 | 0 | 1 | 21 | ○ | ○ | | | ○ | ○ | |
| 0 | 1 | 0 | 1 | 1 | 0 | 22 | ○ | ○ | ○ | | | ○ | |
| 0 | 1 | 0 | 1 | 1 | 1 | 23 | ○ | ○ | ○ | | ○ | ○ | |
| 0 | 1 | 1 | 0 | 0 | 0 | 24 | | ○ | | ○ | | | |
| 0 | 1 | 1 | 0 | 0 | 1 | 25 | | ○ | | ○ | ○ | | |
| 0 | 1 | 1 | 0 | 1 | 0 | 26 | | ○ | ○ | ○ | | | |
| 0 | 1 | 1 | 0 | 1 | 1 | 27 | | ○ | ○ | ○ | ○ | | |
| 0 | 1 | 1 | 1 | 0 | 0 | 28 | | ○ | | ○ | | | ○ |
| 0 | 1 | 1 | 1 | 0 | 1 | 29 | | ○ | | ○ | ○ | | ○ |
| 0 | 1 | 1 | 1 | 1 | 0 | 30 | | ○ | ○ | ○ | | | ○ |
| 0 | 1 | 1 | 1 | 1 | 1 | 31 | | ○ | ○ | ○ | ○ | | ○ |
| 1 | 0 | 0 | 0 | 0 | 0 | 32 | | ○ | | ○ | | ○ | |
| 1 | 0 | 0 | 0 | 0 | 1 | 33 | | ○ | | ○ | ○ | ○ | |
| 1 | 0 | 0 | 0 | 1 | 0 | 34 | | ○ | ○ | ○ | | ○ | |
| 1 | 0 | 0 | 0 | 1 | 1 | 35 | | ○ | ○ | ○ | ○ | ○ | |
| 1 | 0 | 0 | 1 | 0 | 0 | 36 | ○ | ○ | | ○ | | ○ | |
| 1 | 0 | 0 | 1 | 0 | 1 | 37 | ○ | ○ | | ○ | ○ | ○ | |
| 1 | 0 | 0 | 1 | 1 | 0 | 38 | ○ | ○ | ○ | ○ | | ○ | |
| 1 | 0 | 0 | 1 | 1 | 1 | 39 | ○ | ○ | ○ | ○ | ○ | ○ | |
| 1 | 0 | 1 | 0 | 0 | 0 | 40 | ○ | ○ | | ○ | | ○ | ○ |
| 1 | 0 | 1 | 0 | 0 | 1 | 41 | ○ | ○ | | ○ | ○ | ○ | ○ |
| 1 | 0 | 1 | 0 | 1 | 0 | 42 | ○ | ○ | ○ | ○ | | ○ | ○ |
| 1 | 0 | 1 | 0 | 1 | 1 | 43 | ○ | ○ | ○ | ○ | ○ | ○ | ○ |
| DT7 | DT6 | DT5 | DT4 | DT3 | DT2 | | Q3 | Q5 | Q2 | Q7 | Q1 | Q6 | Q4 |

(SAME)

FIG. 19

| LEVEL | DT7 | DT6 | DT5 | DT4 | DT3 | DT2 | | Q7 (16) | Q6 (8) | Q5 (8) | Q4 (4) | Q3 (4) | Q2 (2) | Q1 (1) | AFTER |
|---|---|---|---|---|---|---|---|---|---|---|---|---|---|---|---|
| | SUBJECT TO CONVERSION | | | | NOT SUBJECT TO CONVERSION | | | SUBJECT TO CONVERSION | | | | | NOT SUBJECT TO CONVERSION | | |
| 42 | 1 | 0 | 1 | 0 | 1 | 0 | OK → | 1 | 1 | 1 | 1 | 1 | 1 | 0 | 42 |
| 43 | 1 | 0 | 1 | 0 | 1 | 1 | OK → | 1 | 1 | 1 | 1 | 1 | 1 | 1 | 43 |
| 44 | 1 | 0 | 1 | 1 | 0 | 0 | NG → | 1 | 1 | 1 | 1 | 1 | 0 | 0 | 40 |
| 45 | 1 | 0 | 1 | 1 | 0 | 1 | NG → | 1 | 1 | 1 | 1 | 1 | 0 | 1 | 41 |

FIG. 20

| LEVEL | DT7 | DT6 | DT5 | DT4 | DT3 | DT2 | RMA7 | RMA6 | RMA5 | RMA4 | RMA3 | RMA2 | Q7 (16) | Q6 (8) | Q5 (8) | Q4 (4) | Q3 (4) | Q2 (2) | Q1 (1) | AFTER |
|---|---|---|---|---|---|---|---|---|---|---|---|---|---|---|---|---|---|---|---|---|
| 42 | 1 | 0 | 1 | 0 | 1 | 0 | 1 | 0 | 1 | 0 | 1 | 0 | 1 | 1 | 1 | 1 | 1 | 1 | 0 | 42 |
| 43 | 1 | 0 | 1 | 0 | 1 | 1 | 1 | 0 | 1 | 0 | 1 | 1 | 1 | 1 | 1 | 1 | 1 | 1 | 1 | 43 |
| 44 | 1 | 0 | 1 | 1 | 0 | 0 | 1 | 0 | 1 | 0 | 1 | 1 | 1 | 1 | 1 | 1 | 1 | 1 | 1 | 43 |
| 45 | 1 | 0 | 1 | 1 | 0 | 1 | 1 | 0 | 1 | 0 | 1 | 1 | 1 | 1 | 1 | 1 | 1 | 1 | 1 | 43 |
| 46 | | | | | | | | | | | | | | | | | | | | 43 |

CONVERSION BY LIMITED CIRCUIT

DUPLICATED SUB-FRAME CONVERSION

| | CRY | Q |
|---|---|---|
| DT<DLMT | 0 | DT |
| DT=DLMT | 0 | DT |
| DT>DLMT | 1 | DLMT |

1

| | | | | |
|---|---|---|---|---|
| A | B | A | B | A |
| B | A | B | A | B |
| A | B | A | B | A |
| B | A | B | A | B |
| A | B | A | B | A |

| | | | | |
|---|---|---|---|---|
| A | A | B | B | A |
| A | A | B | B | A |
| B | B | A | A | B |
| B | B | A | A | B |
| A | A | B | B | A |

| | | | | |
|---|---|---|---|---|
| A | B | C | D | A |
| B | C | D | A | B |
| C | D | A | B | C |
| D | A | B | C | D |
| A | B | C | D | A |

| Dsft | SFT INPUT | | | | MUX OUTPUT | | | |
|---|---|---|---|---|---|---|---|---|
| | S3 | S2 | S1 | S0 | Q3 | Q2 | Q1 | Q0 |
| 0 | RMA3 | RMA2 | RMA1 | RMA0 | RMA3 | RMA2 | RMA1 | RMA0 |
| 1 | 0 | RMA3 | RMA2 | RMA1 | RMD3 | RMA3 | RMA2 | RMA1 |
| 2 | 0 | 0 | RMA3 | RMA2 | RMD3 | RMD2 | RMA3 | RMA2 |
| 3 | 0 | 0 | 0 | RMA3 | RMD3 | RMD2 | RMD1 | RMA3 |
| 4 | 0 | 0 | 0 | 0 | RMD3 | RMD2 | RMD1 | RMD0 |

(0 MEANS L LEVEL SIGNAL)

FIG. 27

| LEVEL | ORDER OF SUB-FRAMES | | | | | | |
|---|---|---|---|---|---|---|---|
| | 4 (1) | 8 (1) | 2 | 16 | 1 | 8 (2) | 4 (2) |
| 0 | | | | | | | |
| 1 | | | | | ○ | | |
| 2 | | | ○ | | | | |
| 3 | | | ○ | | ○ | | |
| 4 | | | | | | | ○ |
| 5 | | | | | ○ | | ○ |
| 6 | | | ○ | | | | ○ |
| 7 | | | ○ | | ○ | | ○ |
| 8 | ○ | | | | | | ○ |
| 9 | ○ | | | | ○ | | ○ |
| 10 | ○ | | ○ | | | | ○ |
| 11 | ○ | | ○ | | ○ | | ○ |
| 12 | ○ | | | | | ○ | |
| 13 | ○ | | | | ○ | ○ | |
| 14 | ○ | | ○ | | | ○ | |
| 15 | ○ | | ○ | | ○ | ○ | |
| 16 | | ○ | | | | ○ | |
| 17 | | ○ | | | ○ | ○ | |
| 18 | | ○ | ○ | | | ○ | |
| 19 | | ○ | ○ | | ○ | ○ | |
| 20 | | ○ | | | | ○ | ○ |
| 21 | | ○ | | | ○ | ○ | ○ |

| LEVEL | ORDER OF SUB-FRAMES | | | | | | |
|---|---|---|---|---|---|---|---|
| | 4 (1) | 8 (1) | 2 | 16 | 1 | 8 (2) | 4 (2) |
| 22 | | ○ | ○ | | | ○ | ○ |
| 23 | | ○ | ○ | | ○ | ○ | ○ |
| 24 | | | | ○ | | ○ | |
| 25 | | | | ○ | ○ | ○ | |
| 26 | | | ○ | ○ | | ○ | |
| 27 | | | ○ | ○ | ○ | ○ | |
| 28 | ○ | ○ | | ○ | | | |
| 29 | ○ | ○ | | ○ | ○ | | |
| 30 | ○ | ○ | ○ | ○ | | | |
| 31 | ○ | ○ | ○ | ○ | ○ | | |
| 32 | | ○ | | ○ | | ○ | |
| 33 | | ○ | | ○ | ○ | ○ | |
| 34 | | ○ | ○ | ○ | | ○ | |
| 35 | | ○ | ○ | ○ | ○ | ○ | |
| 36 | | ○ | | ○ | | ○ | ○ |
| 37 | | ○ | | ○ | ○ | ○ | ○ |
| 38 | | ○ | ○ | ○ | | ○ | ○ |
| 39 | | ○ | ○ | ○ | ○ | ○ | ○ |
| 40 | ○ | ○ | | ○ | | ○ | ○ |
| 41 | ○ | ○ | | ○ | ○ | ○ | ○ |
| 42 | ○ | ○ | ○ | ○ | | ○ | ○ |
| 43 | ○ | ○ | ○ | ○ | ○ | ○ | ○ |

(SECOND MODE)

FIG. 29

| GRAY SCALE LEVEL SIGNAL | ADDRESS | OUTPUT | SFT | SF | CONVERTED OUTPUT |
|---|---|---|---|---|---|
| 4 bits (DT7-4) | 4 bits (RMA7-4) | 5 bits (RMD7-3) | 4 | 5 | RMD7-3 |
| | | 6 bits (RMD7-2) | 4 | 6 | RMD7-2 |
| | | 7 bits (RMD7-1) | 4 | 7 | RMD7-1 |
| | | 8 bits (RMD7-0) | 4 | 8 | RMD7-0 |
| 5 bits (DT7-3) | 4 bits (RMA7-4) | 5 bits (RMD7-3) | 1 | 6 | RMD7-3 RMA3 |
| | | 6 bits (RMD7-2) | 2 | 7 | RMD7-2 RMA3 |
| | | 7 bits (RMD7-1) | 3 | 8 | RMD7-1 RMA3 |
| 6 bits (DT7-2) | 4 bits (RMA7-4) | 5 bits (RMD7-3) | 1 | 7 | RMD7-3 RMA3,2 |
| | | 6 bits (RMD7-2) | 2 | 8 | RMD7-2 RMA3,2 |
| 7 bits (DT7-1) | 4 bits (RMA7-4) | 5 bits (RMD7-3) | 1 | 8 | RMD7-3 RMA3-1 |

FIG. 30

| LEVEL | ORDER OF SUB-FRAMES | | | | | | | |
|---|---|---|---|---|---|---|---|---|
| | 8 (1) | 16 (1) | 2 | 8 (3) | 4 | 1 | 16 (2) | 8 (2) |
| 0 | | | | | | | | |
| 1 | | | | | | ○ | | |
| 2 | | | ○ | | | | | |
| 3 | | | ○ | | | ○ | | |
| 4 | | | | | ○ | | | |
| 5 | | | | | ○ | ○ | | |
| 6 | | | ○ | | ○ | | | |
| 7 | | | ○ | | ○ | ○ | | |
| 8 | | | | ○ | | | | |
| 9 | | | | ○ | | ○ | | |
| 10 | | | ○ | ○ | | | | |
| 11 | | | ○ | ○ | | ○ | | |
| 12 | | | | ○ | ○ | | | |
| 13 | | | | ○ | ○ | ○ | | |
| 14 | | | ○ | ○ | ○ | | | |
| 15 | | | ○ | ○ | ○ | ○ | | |
| 16 | | | | ○ | | | | ○ |
| 17 | | | | ○ | | ○ | | ○ |
| 18 | | | ○ | ○ | | | | ○ |
| 19 | | | ○ | ○ | | ○ | | ○ |
| 20 | | | | ○ | ○ | | | ○ |
| 21 | | | | ○ | ○ | ○ | | ○ |
| 22 | | | ○ | ○ | ○ | | | ○ |
| 23 | | | ○ | ○ | ○ | ○ | | ○ |
| 24 | ○ | | | ○ | | | | ○ |
| 25 | ○ | | | ○ | | ○ | | ○ |
| 26 | ○ | | ○ | ○ | | | | ○ |
| 27 | ○ | | ○ | ○ | | ○ | | ○ |
| 28 | ○ | | | ○ | ○ | | | ○ |
| 29 | ○ | | | ○ | ○ | ○ | | ○ |
| 30 | ○ | | ○ | ○ | ○ | | | ○ |
| 31 | ○ | | ○ | ○ | ○ | ○ | | ○ |

| LEVEL | ORDER OF SUB-FRAMES | | | | | | | |
|---|---|---|---|---|---|---|---|---|
| | 8 (1) | 16 (1) | 2 | 8 (3) | 4 | 1 | 16 (2) | 8 (2) |
| 32 | ○ | | | ○ | | | ○ | |
| 33 | ○ | | | ○ | | ○ | ○ | |
| 34 | ○ | | ○ | ○ | | | ○ | |
| 35 | ○ | | ○ | ○ | | ○ | ○ | |
| 36 | ○ | | | ○ | ○ | | ○ | |
| 37 | ○ | | | ○ | ○ | ○ | ○ | |
| 38 | ○ | | ○ | ○ | ○ | | ○ | |
| 39 | ○ | | ○ | ○ | ○ | ○ | ○ | |
| 40 | | ○ | | ○ | | | ○ | |
| 41 | | ○ | | ○ | | ○ | ○ | |
| 42 | | ○ | ○ | ○ | | | ○ | |
| 43 | | ○ | ○ | ○ | | ○ | ○ | |
| 44 | | ○ | | ○ | ○ | | ○ | |
| 45 | | ○ | | ○ | ○ | ○ | ○ | |
| 46 | | ○ | ○ | ○ | ○ | | ○ | |
| 47 | | ○ | ○ | ○ | ○ | ○ | ○ | |
| 48 | | ○ | | ○ | | | ○ | ○ |
| 49 | | ○ | | ○ | | ○ | ○ | ○ |
| 50 | | ○ | ○ | ○ | | | ○ | ○ |
| 51 | | ○ | ○ | ○ | | ○ | ○ | ○ |
| 52 | | ○ | | ○ | ○ | | ○ | ○ |
| 53 | | ○ | | ○ | ○ | ○ | ○ | ○ |
| 54 | | ○ | ○ | ○ | ○ | | ○ | ○ |
| 55 | | ○ | ○ | ○ | ○ | ○ | ○ | ○ |
| 56 | ○ | ○ | | ○ | | | ○ | ○ |
| 57 | ○ | ○ | | ○ | | ○ | ○ | ○ |
| 58 | ○ | ○ | ○ | ○ | | | ○ | ○ |
| 59 | ○ | ○ | ○ | ○ | | ○ | ○ | ○ |
| 60 | ○ | ○ | | ○ | ○ | | ○ | ○ |
| 61 | ○ | ○ | | ○ | ○ | ○ | ○ | ○ |
| 62 | ○ | ○ | ○ | ○ | ○ | | ○ | ○ |
| 63 | ○ | ○ | ○ | ○ | ○ | ○ | ○ | ○ |

(SECOND MODE)

FIG. 31

| LEVEL | ORDER OF SUB-FRAMES | | | | | | | |
|---|---|---|---|---|---|---|---|---|
| | 8 (1) | 16 (1) | 2 | 16 (3) | 4 | 1 | 16 (2) | 8 (2) |
| 0 | | | | | | | | |
| 1 | | | | | | ○ | | |
| 2 | | | ○ | | | | | |
| 3 | | | ○ | | | ○ | | |
| 4 | | | | | ○ | | | |
| 5 | | | | | ○ | ○ | | |
| 6 | | | ○ | | ○ | | | |
| 7 | | | ○ | | ○ | ○ | | |
| 8 | ○ | | | | | | | |
| 9 | ○ | | | | | ○ | | |
| 10 | ○ | | ○ | | | | | |
| 11 | ○ | | ○ | | | ○ | | |
| 12 | ○ | | | | ○ | | | |
| 13 | ○ | | | | ○ | ○ | | |
| 14 | ○ | | ○ | | ○ | | | |
| 15 | ○ | | ○ | | ○ | ○ | | |
| 16 | | | | ○ | | | | |
| 17 | | | | ○ | | ○ | | |
| 18 | | | ○ | ○ | | | | |
| 19 | | | ○ | ○ | | ○ | | |
| 20 | | | | ○ | ○ | | | |
| 21 | | | | ○ | ○ | ○ | | |
| 22 | | | ○ | ○ | ○ | | | |
| 23 | | | ○ | ○ | ○ | ○ | | |
| 24 | ○ | | | ○ | | | | |
| 25 | ○ | | | ○ | | ○ | | |
| 26 | ○ | | ○ | ○ | | | | |
| 27 | ○ | | ○ | ○ | | ○ | | |
| 28 | ○ | | | ○ | ○ | | | |
| 29 | ○ | | | ○ | ○ | ○ | | |
| 30 | ○ | | ○ | ○ | ○ | | | |
| 31 | ○ | | ○ | ○ | ○ | ○ | | |
| 32 | ○ | | | ○ | | | | ○ |
| 33 | ○ | | | ○ | | ○ | | ○ |
| 34 | ○ | | ○ | ○ | | | | ○ |
| 35 | ○ | | ○ | ○ | | ○ | | ○ |

| LEVEL | ORDER OF SUB-FRAMES | | | | | | | |
|---|---|---|---|---|---|---|---|---|
| | 8 (1) | 16 (1) | 2 | 16 (3) | 4 | 1 | 16 (2) | 8 (2) |
| 36 | ○ | | | ○ | ○ | | | ○ |
| 37 | ○ | | | ○ | ○ | ○ | | ○ |
| 38 | ○ | | ○ | ○ | ○ | | | ○ |
| 39 | ○ | | ○ | ○ | ○ | ○ | | ○ |
| 40 | | ○ | | ○ | | | | ○ |
| 41 | | ○ | | ○ | | ○ | | ○ |
| 42 | | ○ | ○ | ○ | | | | ○ |
| 43 | | ○ | ○ | ○ | | ○ | | ○ |
| 44 | | ○ | | ○ | ○ | | | ○ |
| 45 | | ○ | | ○ | ○ | ○ | | ○ |
| 46 | | ○ | ○ | ○ | ○ | | | ○ |
| 47 | | ○ | ○ | ○ | ○ | ○ | | ○ |
| 48 | | ○ | | ○ | | | ○ | |
| 49 | | ○ | | ○ | | ○ | ○ | |
| 50 | | ○ | ○ | ○ | | | ○ | |
| 51 | | ○ | ○ | ○ | | ○ | ○ | |
| 52 | | ○ | | ○ | ○ | | ○ | |
| 53 | | ○ | | ○ | ○ | ○ | ○ | |
| 54 | | ○ | ○ | ○ | ○ | | ○ | |
| 55 | | ○ | ○ | ○ | ○ | ○ | ○ | |
| 56 | ○ | ○ | | ○ | | | ○ | |
| 57 | ○ | ○ | | ○ | | ○ | ○ | |
| 58 | ○ | ○ | ○ | ○ | | | ○ | |
| 59 | ○ | ○ | ○ | ○ | | ○ | ○ | |
| 60 | ○ | ○ | | ○ | ○ | | ○ | |
| 61 | ○ | ○ | | ○ | ○ | ○ | ○ | |
| 62 | ○ | ○ | ○ | ○ | ○ | | ○ | |
| 63 | ○ | ○ | ○ | ○ | ○ | ○ | ○ | |
| 64 | ○ | ○ | | ○ | | | ○ | ○ |
| 65 | ○ | ○ | | ○ | | ○ | ○ | ○ |
| 66 | ○ | ○ | ○ | ○ | | | ○ | ○ |
| 67 | ○ | ○ | ○ | ○ | | ○ | ○ | ○ |
| 68 | ○ | ○ | | ○ | ○ | | ○ | ○ |
| 69 | ○ | ○ | | ○ | ○ | ○ | ○ | ○ |
| 70 | ○ | ○ | ○ | ○ | ○ | | ○ | ○ |
| 71 | ○ | ○ | ○ | ○ | ○ | ○ | ○ | ○ |

(FIRST MODE)

FIG. 32

| LEVEL | ORDER OF SUB-FRAMES | | | | | | | |
|---|---|---|---|---|---|---|---|---|
| | 8 (1) | 16 (1) | 2 | 16 (3) | 4 | 1 | 16 (2) | 8 (2) |
| 0 | | | | | | | | |
| 1 | | | | | | ○ | | |
| 2 | | | ○ | | | | | |
| 3 | | | ○ | | | ○ | | |
| 4 | | | | | ○ | | | |
| 5 | | | | | ○ | ○ | | |
| 6 | | | ○ | | ○ | | | |
| 7 | | | ○ | | ○ | ○ | | |
| 8 | ○ | | | | | | | ○ |
| 9 | ○ | | | | | ○ | | ○ |
| 10 | ○ | | ○ | | | | | ○ |
| 11 | ○ | | ○ | | | ○ | | ○ |
| 12 | ○ | | | | ○ | | | ○ |
| 13 | ○ | | | | ○ | ○ | | ○ |
| 14 | ○ | | ○ | | ○ | | | ○ |
| 15 | ○ | | ○ | | ○ | ○ | | ○ |
| 16 | | | | ○ | | | | |
| 17 | | | | ○ | | ○ | | |
| 18 | | | ○ | ○ | | | | |
| 19 | | | ○ | ○ | | ○ | | |
| 20 | | | | ○ | ○ | | | |
| 21 | | | | ○ | ○ | ○ | | |
| 22 | | | ○ | ○ | ○ | | | |
| 23 | | | ○ | ○ | ○ | ○ | | |
| 24 | | | | ○ | | | | ○ |
| 25 | | | | ○ | | ○ | | ○ |
| 26 | | | ○ | ○ | | | | ○ |
| 27 | | | ○ | ○ | | ○ | | ○ |
| 28 | | | | ○ | ○ | | | ○ |
| 29 | | | | ○ | ○ | ○ | | ○ |
| 30 | | | ○ | ○ | ○ | | | ○ |
| 31 | | | ○ | ○ | ○ | ○ | | ○ |
| 32 | ○ | | | ○ | | | | ○ |
| 33 | ○ | | | ○ | | ○ | | ○ |
| 34 | ○ | | ○ | ○ | | | | ○ |
| 35 | ○ | | ○ | ○ | | ○ | | ○ |

| LEVEL | ORDER OF SUB-FRAMES | | | | | | | |
|---|---|---|---|---|---|---|---|---|
| | 8 (1) | 16 (1) | 2 | 16 (3) | 4 | 1 | 16 (2) | 8 (2) |
| 36 | ○ | | | ○ | ○ | | | ○ |
| 37 | ○ | | | ○ | ○ | ○ | | ○ |
| 38 | ○ | | ○ | ○ | ○ | | | ○ |
| 39 | ○ | | ○ | ○ | ○ | ○ | | ○ |
| 40 | ○ | | | ○ | | | ○ | |
| 41 | ○ | | | ○ | | ○ | ○ | |
| 42 | ○ | | ○ | ○ | | | ○ | |
| 43 | ○ | | ○ | ○ | | ○ | ○ | |
| 44 | ○ | | | ○ | ○ | | ○ | |
| 45 | ○ | | | ○ | ○ | ○ | ○ | |
| 46 | ○ | | ○ | ○ | ○ | | ○ | |
| 47 | ○ | | ○ | ○ | ○ | ○ | ○ | |
| 48 | | ○ | | ○ | | | ○ | |
| 49 | | ○ | | ○ | | ○ | ○ | |
| 50 | | ○ | ○ | ○ | | | ○ | |
| 51 | | ○ | ○ | ○ | | ○ | ○ | |
| 52 | | ○ | | ○ | ○ | | ○ | |
| 53 | | ○ | | ○ | ○ | ○ | ○ | |
| 54 | | ○ | ○ | ○ | ○ | | ○ | |
| 55 | | ○ | ○ | ○ | ○ | ○ | ○ | |
| 56 | ○ | ○ | | ○ | | | ○ | ○ |
| 57 | ○ | ○ | | ○ | | ○ | ○ | ○ |
| 58 | ○ | ○ | ○ | ○ | | | ○ | ○ |
| 59 | ○ | ○ | ○ | ○ | | ○ | ○ | ○ |
| 60 | ○ | ○ | | ○ | ○ | | ○ | ○ |
| 61 | ○ | ○ | | ○ | ○ | ○ | ○ | ○ |
| 62 | ○ | ○ | ○ | ○ | ○ | | ○ | ○ |
| 63 | ○ | ○ | ○ | ○ | ○ | ○ | ○ | ○ |
| 64 | ○ | ○ | | ○ | | | ○ | ○ |
| 65 | ○ | ○ | | ○ | | ○ | ○ | ○ |
| 66 | ○ | ○ | ○ | ○ | | | ○ | ○ |
| 67 | ○ | ○ | ○ | ○ | | ○ | ○ | ○ |
| 68 | ○ | ○ | | ○ | ○ | | ○ | ○ |
| 69 | ○ | ○ | | ○ | ○ | ○ | ○ | ○ |
| 70 | ○ | ○ | ○ | ○ | ○ | | ○ | ○ |
| 71 | ○ | ○ | ○ | ○ | ○ | ○ | ○ | ○ |

(SECOND MODE)

FIG. 33

| | | | | | LEVEL | ORDER OF SUB-FRAMES | | | | | |
|---|---|---|---|---|---|---|---|---|---|---|---|
| | | | | | | 4 (1) | 8 (1) | 2 | 1 | 8 (2) | 4 (2) |
| 0 | 0 | 0 | 0 | 0 | 0 | | | | | | |
| 0 | 0 | 0 | 0 | 1 | 1 | | | | ○ | | |
| 0 | 0 | 0 | 1 | 0 | 2 | | | ○ | | | |
| 0 | 0 | 0 | 1 | 1 | 3 | | | ○ | ○ | | |
| 0 | 0 | 1 | 0 | 0 | 4 | ○ | | | | | |
| 0 | 0 | 1 | 0 | 1 | 5 | ○ | | | ○ | | |
| 0 | 0 | 1 | 1 | 0 | 6 | ○ | | ○ | | | |
| 0 | 0 | 1 | 1 | 1 | 7 | ○ | | ○ | ○ | | |
| 0 | 1 | 0 | 0 | 0 | 8 | ○ | | | | | ○ |
| 0 | 1 | 0 | 0 | 1 | 9 | ○ | | | ○ | | ○ |
| 0 | 1 | 0 | 1 | 0 | 10 | ○ | | ○ | | | ○ |
| 0 | 1 | 0 | 1 | 1 | 11 | ○ | | ○ | ○ | | ○ |
| 0 | 1 | 1 | 0 | 0 | 12 | | ○ | | | | ○ |
| 0 | 1 | 1 | 0 | 1 | 13 | | ○ | | ○ | | ○ |
| 0 | 1 | 1 | 1 | 0 | 14 | | ○ | ○ | | | ○ |
| 0 | 1 | 1 | 1 | 1 | 15 | | ○ | ○ | ○ | | ○ |
| 1 | 0 | 0 | 0 | 0 | 16 | | ○ | | | ○ | |
| 1 | 0 | 0 | 0 | 1 | 17 | | ○ | | ○ | ○ | |
| 1 | 0 | 0 | 1 | 0 | 18 | | ○ | ○ | | ○ | |
| 1 | 0 | 0 | 1 | 1 | 19 | | ○ | ○ | ○ | ○ | |
| 1 | 0 | 1 | 0 | 0 | 20 | ○ | ○ | | | ○ | |
| 1 | 0 | 1 | 0 | 1 | 21 | ○ | ○ | | ○ | ○ | |
| 1 | 0 | 1 | 1 | 0 | 22 | ○ | ○ | ○ | | ○ | |
| 1 | 0 | 1 | 1 | 1 | 23 | ○ | ○ | ○ | ○ | ○ | |
| 1 | 1 | 0 | 0 | 0 | 24 | ○ | ○ | | | ○ | ○ |
| 1 | 1 | 0 | 0 | 1 | 25 | ○ | ○ | | ○ | ○ | ○ |
| 1 | 1 | 0 | 1 | 0 | 26 | ○ | ○ | ○ | | ○ | ○ |
| 1 | 1 | 0 | 1 | 1 | 27 | ○ | ○ | ○ | ○ | ○ | ○ |
| DT7 | DT6 | DT5 | DT4 | DT3 | | Q4 | Q6 | Q3 | Q2 | Q7 | Q5 |

FIG. 34

| LEVEL | ORDER OF SUB-FRAMES | | | | | |
|---|---|---|---|---|---|---|
| | 4 (1) | 8 (1) | 2 | 1 | 8 (2) | 4 (2) |
| 0 | | | | | | |
| 1 | | | | ○ | | |
| 2 | | | ○ | | | |
| 3 | | | ○ | ○ | | |
| 4 | | | | | | ○ |
| 5 | | | | ○ | | ○ |
| 6 | | | ○ | | | ○ |
| 7 | | | ○ | ○ | | ○ |
| 8 | ○ | | | | | ○ |
| 9 | ○ | | | ○ | | ○ |
| 10 | ○ | | ○ | | | ○ |
| 11 | ○ | | ○ | ○ | | ○ |
| 12 | ○ | | | | ○ | |
| 13 | ○ | | | ○ | ○ | |
| 14 | ○ | | ○ | | ○ | |
| 15 | ○ | | ○ | ○ | ○ | |
| 16 | | ○ | | | ○ | |
| 17 | | ○ | | ○ | ○ | |
| 18 | | ○ | ○ | | ○ | |
| 19 | | ○ | ○ | ○ | ○ | |
| 20 | | ○ | | | ○ | ○ |
| 21 | | ○ | | ○ | ○ | ○ |
| 22 | | ○ | ○ | | ○ | ○ |
| 23 | | ○ | ○ | ○ | ○ | ○ |
| 24 | ○ | ○ | | | ○ | ○ |
| 25 | ○ | ○ | | ○ | ○ | ○ |
| 26 | ○ | ○ | ○ | | ○ | ○ |
| 27 | ○ | ○ | ○ | ○ | ○ | ○ |

(SECOND MODE)

| LEVEL | LIGHTENED |
|---|---|
| 1 | SF1 |
| 2 | SF2 |
| 3 | SF1, SF2 |
| 4 | SF3 |
| 5 | SF3, SF1 |
| ---- | |
| 30 | SF2 ~ SF5 |
| 31 | SF1 ~ SF5 |
| 32 | SF6 |
| ---- | |
| 63 | SF1 ~ SF6 |

DISPLAY DEVICE AND METHOD FOR DRIVING THE SAME

BACKGROUND OF THE INVENTION

1. Field of the Invention

The present invention relates to an improvement in display control, consonant with multi-scanning, for controlling a display device which provides a multiple-level gray scale display. In particular, the present invention provides this improvement by using an intraframe time-division multiplexing method, such as a display device employing a plasma display panel or a liquid crystal display panel, and to improvement of a driving method therefor.

2. Background of the Invention

Recently, a display device employing a plasma display panel (hereinafter referred to as a PDP) and a liquid crystal display panel (hereinafter referred to as an LCD) has been developed and produced that satisfies a demand for a large screen, and for a reduction in the size of display devices.

Such a display panel has only two stable operating states, i.e., the light-on state and the light-off state, or the bright state and the dark state. Therefore, a multiple-level gray scale display is provided by using the intraframe time-division multiplexing method to provide full color using RGB signals. This intraframe time-division multiplexing method is a method by which, when a single frame synchronized with a vertical synchronization signal has a cycle of 1/60 second, a lighting operation is repeated in consonance with the brightness during one frame period of 1/60 second (approximately 16.7 msec), and a difference in brightness is expressed.

Although the intraframe time-division multiplexing method is a well known technique, it will be briefly explained by employing a PDP display device as an example in order to describe the present invention.

FIG. 35 is a schematic diagram illustrating the arrangement of a PDP display device of a three-electrode type. FIG. 36 is a detailed cross sectional view of one of the discharge cells 10 for the PDP. As is shown in FIGS. 35 and 36, an X electrode 14, which is common to all the cells, and a Y electrode 15, which is independently driven by scanning, are provided in parallel on one glass substrate 13, and an address electrode 16, which is perpendicular to X and Y electrodes 14 and 15 and which can be independently driven, is provided on the other glass substrate 12. A wall 17 is so formed that it encloses a cell region 10, which is defined by the X electrode 14, the Y electrode 15, and the address electrode 16 perpendicular to them, and a discharge space 20 is thus defined. The X electrode 14 and the Y electrode 15 are covered with a dielectric layer 18 and an overlying protective layer 21. A luminophor 19 corresponding to red, blue or green (RGB) is formed in the region on the glass plate 12 that is enclosed by the wall 17. As is shown in FIG. 35, three RGB cells 10 for RGB constitute one pixel for a display. A driving circuit 3, employed in common by the Y electrodes, scans the Y electrodes 15 via the respective Y electrode driving circuits 41–4n. Reference numeral 5 denotes a driving circuit for the X electrode 14, and reference numeral 6 denotes a driving circuit for the address electrodes 16.

FIG. 37 is a waveform diagram for explaining the driving operations for the individual electrodes of the above described PDP device. As is shown in FIG. 37, one frame being synchronized with a vertical synchronization signal Vsync is divided into, for example, six sub-frames, SF1 through SF6. Each sub-frame SF consists of a reset period S1, for data writing and erasing; an addressing period S2, for lightening on a desired cell 10 for a display; and a sustained discharge period S3, for providing brightness for the lightened cell.

The driving operation for, for example, the sub-frame SF6 will be explained. First, during the reset period S1, a writing pulse WP is applied to the electrode 14 in order to apply a high voltage, which is required for plasma discharge, between the X electrode 14 and the Y electrodes 15, and to induce plasma discharge at all the cells. Immediately after this, an erasing pulse is applied to all the Y electrodes 15 and the X electrode 14, and temporarily, plasma discharge at all the cells is erased. As a result, a wall electric charge is more or less present in both the cells wherein data was written and in the cells wherein data was not written. Thus, although a discharge is induced by the application of an address pulse during the succeeding addressing period S2, no discharge occurs upon the application of a sustained discharge pulse (sustained pulse) during the sustained discharge period S3.

Following this, during the addressing period S2, while an address pulse ADP is applied to the address electrodes 16-1 through 16-m that corresponds to a cell to be lightened, a scan pulse SCP is applied to the Y electrode 15 so as to be scan-driven. As a result, plasma discharge occurs in the cell region to be lightened among the all cells in a screen. During the succeeding sustained discharge period S3, the sustained discharge pulse is applied to the X electrode 14 and all the Y electrodes 15, and thus a given brightness is supplied to the lightened cells during the addressing period S2.

Since theoretically the PDP device and the LCD device have only two conditions of whether or not discharge is performed between two panels, the six sub-frames SF1 through SF6 having different sustained discharge periods S3 constitute one frame, in order to realize a multiple-level gray scale display, the six sub-frames SF1 through SF6 having different sustained discharge periods S3 constitute one frame, as is shown in FIG. 37. That is, one frame is constituted by six sub-frames SF1 through SF6, which can express brightnesses having weights of 1, 2, 4, 8, 16 and 32 by using the weight method. With this structure, as is shown in FIG. 38, gray scale levels 0 through 63 can be expressed. In other words, the lightening is done only at the sub-frame SF1 for gray scale level 1, the lightening is done at the sub-frames SF1 and SF3 for gray scale level 5, and the lightening is done at all the sub-frames SF1 through SF6 for gray scale level 63.

One frame consists of six sub-frame SFs, because since the scanning during the addressing period S2 requires a considerable time of, for example, 2 msec, therefore considering the reset period S1 and the sustained discharge period S3 required for each sub-frame SF, six sub-frames are the limit for the above described single frame of 16.7 msec. When, for example, the addressing period S2 is shorter, however, multi-level gray scales can be provided by seven sub-frames or eight sub-frames. Therefore, the employment of six sub-frames is merely one example.

If a plurality of sub-frames weighted as is described above are lightened on in order of their weights under a time-division manner, so-called flicker and false color contours appear in a display in case of sequential gradations being displayed, and accordingly a picture quality is deteriorated. Such an example is shown in FIGS. 39 and 40. In FIG. 39 is shown an example wherein gray scale 31 and gray scale 32 in FIG. 38 are alternately displayed by each frame. For gradation 31, the sub-frames SF1 through SF5 (weights 1, 2, 4, 8 and 16) are lightened on, while for gradation 32, the sub-frame SF6 (weight 32) is lightened on. Even if lighting is correctly performed in the frame, along the time axis, the lighting at gray scale 63 and the state at gray scale 0 are alternately repeated virtually. From this phenomenon, low-frequency elements of 30 Hz are generated at the frame frequency of 60 Hz, and flicker occurs. In FIG. 40 is shown an example wherein gray scales 15 and 16 are alternately repeated in the same manner; this also causes a flicker.

To prevent the occurrence of a flicker phenomenon, a method is proposed by which sub-frames SF16 and SF 32, both having a high luminance level, are located near the center of one frame along the time axis. However, so long as a sub-frame having an extremely high luminance is employed, the array of sub-frames is not smooth, and a so-called false colored contour phenomenon occurs. When, for example, the skin-colored portion of a person moves, a wine-red or green false colored contour is generated at the skin-colored portion and the picture quality of a moving image is deteriorated.

In order to resolve the problem presented by such a false colored contour, the present inventors have proposed in, for example, Japanese Patent Application No. Hei 6-264244 and corresponding U.S. patent application Ser. No. 368,002, a method whereby a sub-frame having high luminance is divided and an optimal array of the obtained sub-frames is provided for each gray scale. The present inventors call this method a duplicated subframe method.

As is described previously, the number of sub-frames is determined on the assumption there is a 60 Hz frequency, which is a standard frequency for a vertical synchronization signal according to the NTSC (National Television Standard Committee), and for the VGA (Video Graphic Array). In consonance with the determined number of sub-frames, the types and orders for the sub-frames in one frame are determined.

Lately, a flat display device has been employed not only for an image display, but also for the display of information by being connected to a computer, etc. In the latter case, in consonance with the ability of the connected computer, the display device must provide a multi-scan display at a vertical synchronization frequency of 60 Hz or higher, e.g., 70 Hz or 120 Hz. In such a case, since a period for one frame is shortened, if the above described method of intraframe time-division multiplexing is employed, all the sub-frames, for which the count was determined based on the 60 Hz frequency assumption, can not be driven.

When all the expected sub-frames can not be driven, luminances at expected gray scale levels can not be provided. Further, if the sequence for driving the sub-frames is interrupted, the discharge sequence for the PDP is accordingly halted, and destruction of a panel due to the unnecessary charging and discharging of electric charges will be induced.

In addition, in order to perform a time-division display in a frame by using the duplicated subframe method, a plurality of bit signals representing a gray scale level in a binary system must be converted into a proper combination of a plurality of sub-frames with appropriate weighting. For such conversion, a look-up table employing a semiconductor memory is ordinarily used. According to the above described duplicated subframe method, however, a plurality of types of conversion tables are prepared in advance and are switched pixel by pixel so as to increase picture quality. Further, since one frame may be constituted by six sub-frames, or by seven or eight sub-frames, in consonance with the performance of the PDP to be used, conversion tables for each frames must be prepared.

Thus, a huge memory capacity is required for the conversion tables.

As the result of a discussion of conversion tables for performing the duplicated subframe method, the present inventors found a specific method which considerably reduces the memory capacity required for the look-up tables, which are the conversion tables, and thus provides the present invention.

It is therefore one object of the present invention to provide a display device which can flexibly cope with a high vertical synchronization frequency due to the above described multi-scanning.

It is another object of the present invention to provide a display device which can alter the number of sub-frames in consonance with vertical synchronization signals having different frequencies.

It is an additional object of the present invention to provide a display device which can change a pseudomultiple-level gray scale conversion, a duplicated subframe conversion, and a sub-frame driving operation in consonance with the determined number of sub-frames that correspond to vertical synchronization signals having different frequencies.

It is a further object of the present invention to provide a flat panel display device that can reduce the memory capacity required for conversion tables employed for the duplicated subframe method so as to realize high picture quality.

It is a still further object of the present invention to provide a display device that can increase the number of conversion tables, which can be stored in a memory as look-up tables, by reducing the capacity of each conversion table, and can thus realize high picture quality.

It is still another object of the present invention to provide a more compact PDP display device having a high picture quality that can reduce the required semi-conductor memory capacity for look-up tables.

SUMMARY OF THE INVENTION

To achieve the above objects, a display device according to the present invention is a display device, displaying a multiple-level gray scale picture through a frame having a plurality of sub-frames which are time-divided in accordance with weight value of gray scale for each sub-frame, comprising: sub-frame selection circuit, being supplied with an vertical synchronization signal, for selecting the number of the sub-frames which can be displayed within the period for the single frame in accordance with the frequency of the vertical synchronization signal, and for providing a sub-frame selection signal corresponding to the number of the sub-frames; and display control circuit, operatively connected to the sub-frame selection circuit, for receiving the sub-frame selection signal and an input display data signal and for controlling said display of the multi-level gray scale picture in accordance with the selected number of the sub-frames.

Further, to achieve the above objects, a method of the present invention is a method of driving a display device, said display device displaying a multiple-level gray scale picture through a frame having a plurality of sub-frames which are time-divided in accordance with weight value of gray scale for each sub-frame, comprising steps of: selecting the number of the sub-frames which can be displayed within the period for the single frame in accordance with a frequency of a vertical synchronization signal to be provided to the display device, and providing a sub-frame selection signal corresponding to the number of the sub-frames; and providing a display control circuit with the sub-frame selection signal and controlling said display of the multi-level gray scale picture in accordance with the selected number of the sub-frames.

With the above described arrangement, the optimal number of sub-frame can be determined in accordance with a frequency of a vertical synthesization signal input to a panel display device, such as a PDP or an LCD, and the display control can thus be performed.

According to this invention, the display control circuit is so designed that it can make various settings in consonance with the selected number of sub-frames. For example, an initial value selected by the sub-frame selection signal is input to a sub-frame counter for outputting the order number of the sub-frame currently being displayed. As a result, the display control can be exercised only by changing the initial value. In addition, a pseudo-multiple-level gray scale conversion section for outputting a pseudo-multiple-level gray scale signal representing an input gray scale by a smaller bit number than that of an input display data signal variably sets the number of output bits of the pseudo-multiple-level gray scale signal in consonance with the selected number of sub-frames. Further, when a display data converter, for converting a gray-scale signal into a display data signal having a combination of predetermined sub-frames, is provided to increase picture quality, the conversion tables are altered in consonance with the selected number of sub-frames. This is because, as the number of sub-frames to be driven is determined, a display data signal having a bit number equivalent to the determined number of sub-frames must be output.

When the number of sub-frames is variably set, the setting of a variable sustained pulse number for each sub-frame during a sustained period is also required. In such a case, the number of sustained pulses is so determined that it corresponds to weighted values consonant with luminances or brightness of sub-frames to be output by a display data converter.

To achieve the above objects, a display device according to the present invention is a display device, displaying a multiple-level gray scale picture through a frame having a plurality of sub-frames which are time-divided in accordance with weight value of gray scale for each sub-frame, comprising: a conversion table section, receiving a part of bit signals of a multiple-level gray scale signal having a plurality of bits corresponding to different gray scale level as an address signal and outputting a duplicated subframe conversion signal having a predetermined set of the plural sub-frames converted from the input address signals through a conversion table stored therein; a synthesizer, operatively connected to the conversion table section, for synthesizing the remaining bit signals of the multiple-level gray scale signal and the duplicated subframe conversion signal according to the gray scale thereof so as to produce plural subframes signal for a single frame; and display control circuit, operatively connected to the synthesizer, for displaying the multiple-level gray scale picture in a display portion according to the synthesized plural subframes signal.

Furthermore, to achieve the above objects of the present invention, another aspect of the present invention is a display device, displaying a multiple-level gray scale picture through a frame having a plurality of sub-frames which are time-divided in accordance with weight value of gray scale for each sub-frame, comprising: a conversion table section, receiving a part of plural bit signals of a multiple-level gray scale signal having a plurality of bits corresponding to different gray scale level as an address signal and outputting a duplicated subframe conversion signal having a predetermined set of the plural sub-frames converted from the input address signals through a conversion table stored therein, said duplicated subframe conversion signal including a plurality of sub-frames which have the same weight value of gray scale; a synthesizer, operatively connected to the conversion table section, for shifting multiple-level gray scale signal in predetermined bits in case where the bit number of the duplicated subframe conversion signal is larger than the bit number of the address signal for the conversion table section, and for synthesizing the shifted remaining bit signals of the multiple-level gray scale signal and the duplicated subframe conversion signal according to the gray scale thereof so as to produce plural subframes signal for a single frame; a limit circuit, operatively connected to the conversion table section at the front stage thereof, for limiting the multiple-level gray scale signal not higher than a second gray scale level in case where a first gray scale level according to the multiple-level gray scale signal is larger than the second gray scale level according the synthesized subframes signal; and display control circuit, operatively connected to the synthesizer, for displaying the multiple-level gray scale picture in a display portion according to the synthesized plural subframes signal.

In addition, to achieve the above objects, an additional aspect of the present invention is a method for driving a display device, the display device displaying a multiple-level gray scale picture through a frame having a plurality of sub-frames which are time-divided in accordance with weight value of gray scale for each sub-frame, comprising the steps of: receiving a part of bit signals of a multiple-level gray scale signal having a plurality of bits corresponding to different gray scale level as an address signal and outputting a duplicated subframe conversion signal having a predetermined set of the plural sub-frames converted from the input address signals through a conversion table stored therein; synthesizing the remaining bit signals of the multiple-level gray scale signal and the duplicated subframe conversion signal according to the gray scale thereof so as to produce plural subframes signal for a single frame; and displaying the multiple-level gray scale picture in a display portion according to the synthesized plural subframes signal.

The display device having the above described arrangement can reduce the memory required for a duplicated subframe conversion table section. Further, since the memory required for one conversion table can be reduced, a plurality of conversion tables can be stored in the memory so that the picture quality can be enhanced. Further, because of the reduction in the memory capacity, the display device can be more compactly constructed.

BRIEF DESCRIPTION OF THE DRAWINGS

FIG. 3 is a table in sub-frame selection circuit;

FIGS. 9A, 9B and 9C are truth tables for the pseudo-multiple-level gray scale conversion circuit;

FIG. 11 is an example conversion table for eight sub-frames;

FIG. 12 is an example conversion table for seven sub-frames;

FIG. 13 is an example conversion table for six sub-frames;

FIG. 15 is an example table used to convert 6-bit multiple-level gray scale output into seven sub-frames;

FIG. 19 is a chart for explaining the limiting circuit;

FIG. 20 is a chart for explaining the operation of a limiting circuit;

FIG. 27 is another example table for converting a 6-bit multiple-level gray scale output into seven sub-frames;

FIG. 29 is a table for showing a relationship of bits for duplicated subframe conversion;

FIG. 30 is example table (2) for converting 6-bit multiple-level gray scale output into eight sub-frames;

FIG. 31 is example table (1) for converting 7-bit multiple-level gray scale output into eight sub-frames;

FIG. 32 is example table (1) for converting 7-bit multiple-level gray scale output into eight sub-frames;

FIG. 33 is example table (1) for converting 5-bit multiple-level gray scale output into six sub-frames;

FIG. 34 is example table (1) for converting 5-bit multiple-level gray scale output into six sub-frames;

DETAILED DESCRIPTION OF THE PREFERRED EMBODIMENTS

Figure 1:
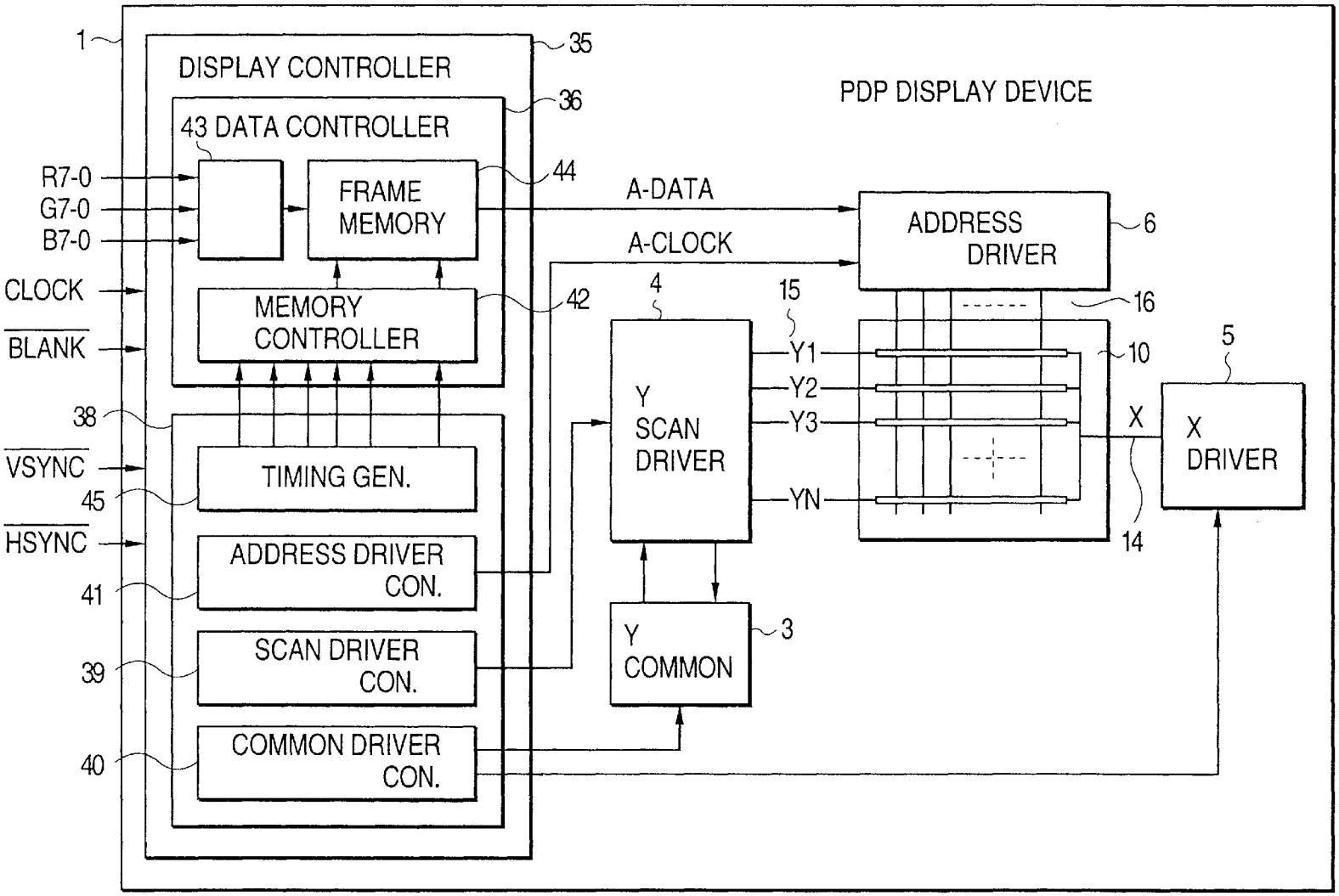
FIG. 1 is a diagram illustrating the general structure of a flat panel display device according to one embodiment of the present invention.

The preferred embodiments of the present invention will now be described while referring to the drawings.

[General structure of display device]

FIG. 1 is a diagram illustrating the general structure of a flat panel display device according to one embodiment of the present invention. An explanation will be given by employing a PDP display device as a flat panel display device; however, the present invention can be applied not only to a PDP display device, but also to an ordinary flat panel display device, such as an LCD device.

Figure 35:
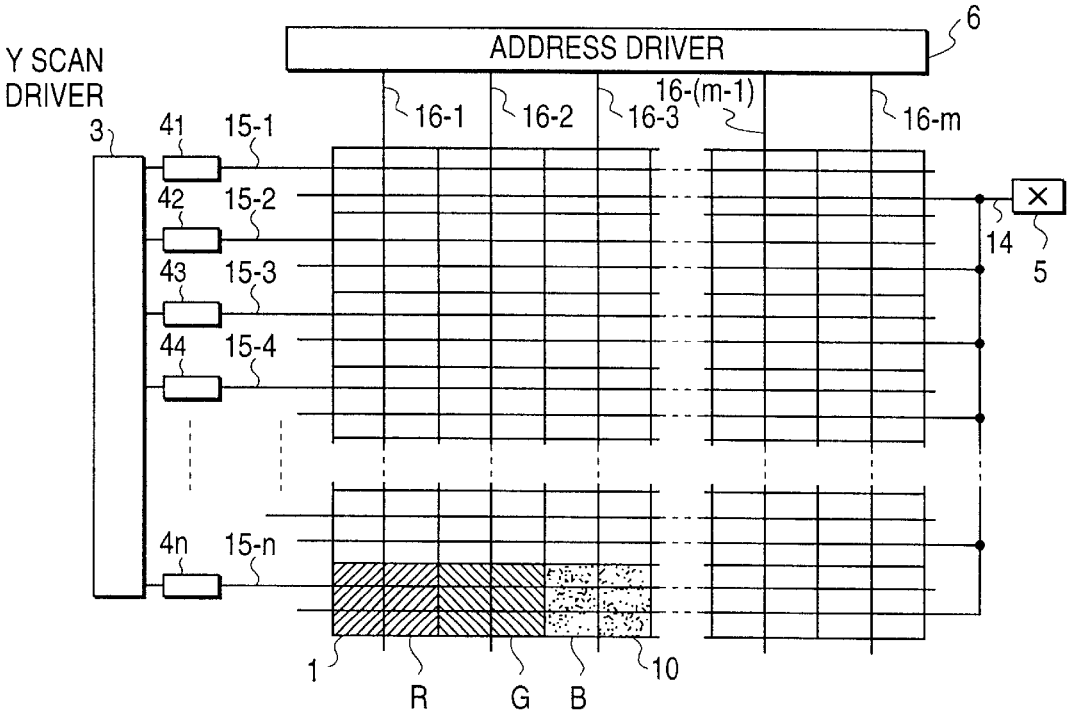
FIG. 35 is a schematic diagram illustrating the general structure of a conventional PDP.
Figure 36:
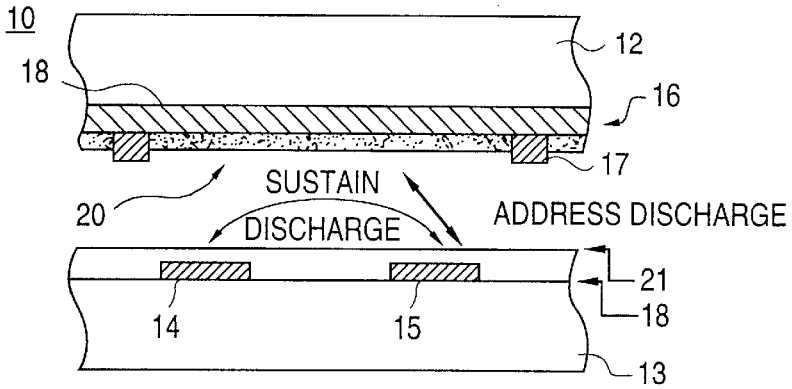
FIG. 36 is a cross sectional view of a discharge cell of a conventional PDP.

In FIG. 1, reference numeral 1 denotes a display panel section; 3, a Y common driver for the driving in common of Y electrodes 15; 4, a Y scan driver for scanning and driving the Y electrodes 15; 5, an X common driver for driving an X electrode 14; and 6, an address driver for driving an address electrode 16. These are the same as those described in FIG. 35.

A display control circuit section 35 is provided for controlling a display on a display panel 10 and a driving section, and has a display data control section 36 and a display panel driving control section 38. These two control sections 36 and 38 are closely related to each other. The display data control section 36 includes a display data preprocessing section 43, for receiving, from a system, display data signals R7-0, G7-0 and B7-0 specifying gray scales for the three primary colors, red, green and blue, and for performing a preprocess, which will be described later; a frame memory 44 in which processed display data are stored; and a frame memory control circuit section 42 for supplying a write address and a read address to the frame memory 44. The display data stored in the frame memory 44 are output as address data A-DATA to the address driver 6, and a desired cell region is lit by scan-driving the corresponding Y electrode in the previously described manner.

A vertical synchronization signal VSYNC, a horizontal synchronization signal HSYNC, a blanking signal BLANK and a dot clock CLOCK are supplied to the display panel driving control section 38, which includes a PDP timing generation section 45 for using the above signals to generate various timing signals; an address driver control section 41; a scan driver control section 39; and a common driver control section 40.

[Sub-frame counter]

Figure 2:
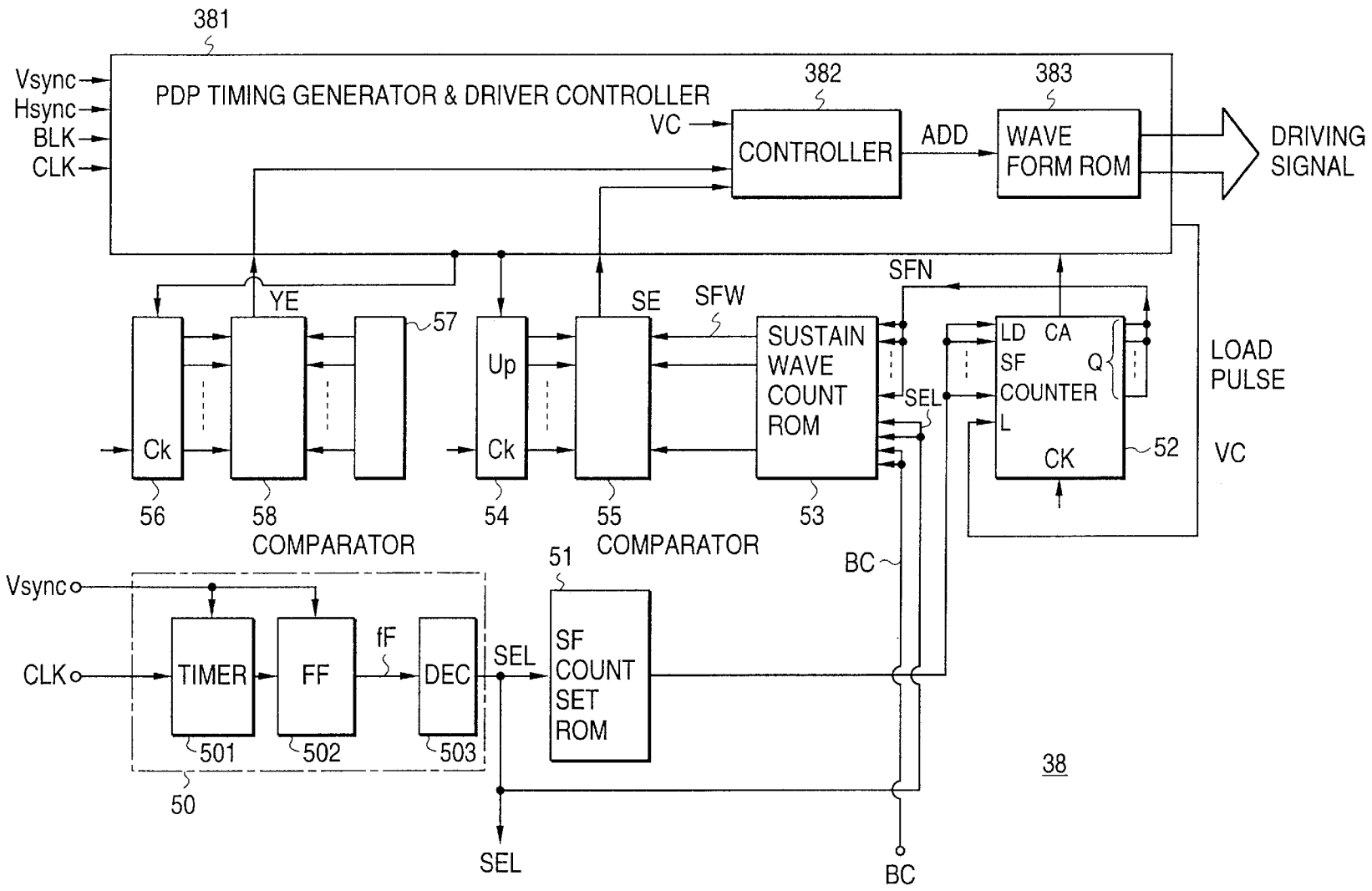
FIG. 2 is a circuit diagram illustrating one part of a display panel driving control section.

FIG. 2 is a detailed circuit diagram illustrating one part of the display panel drive control section 38. In a block 381 in the upper portion the PDP timing generation section 45 and the driver control section 40 are specified, and in the remainder of the diagram other than the block 381 is illustrated the remainder of the PDP timing generation section 45.

Figure 37:
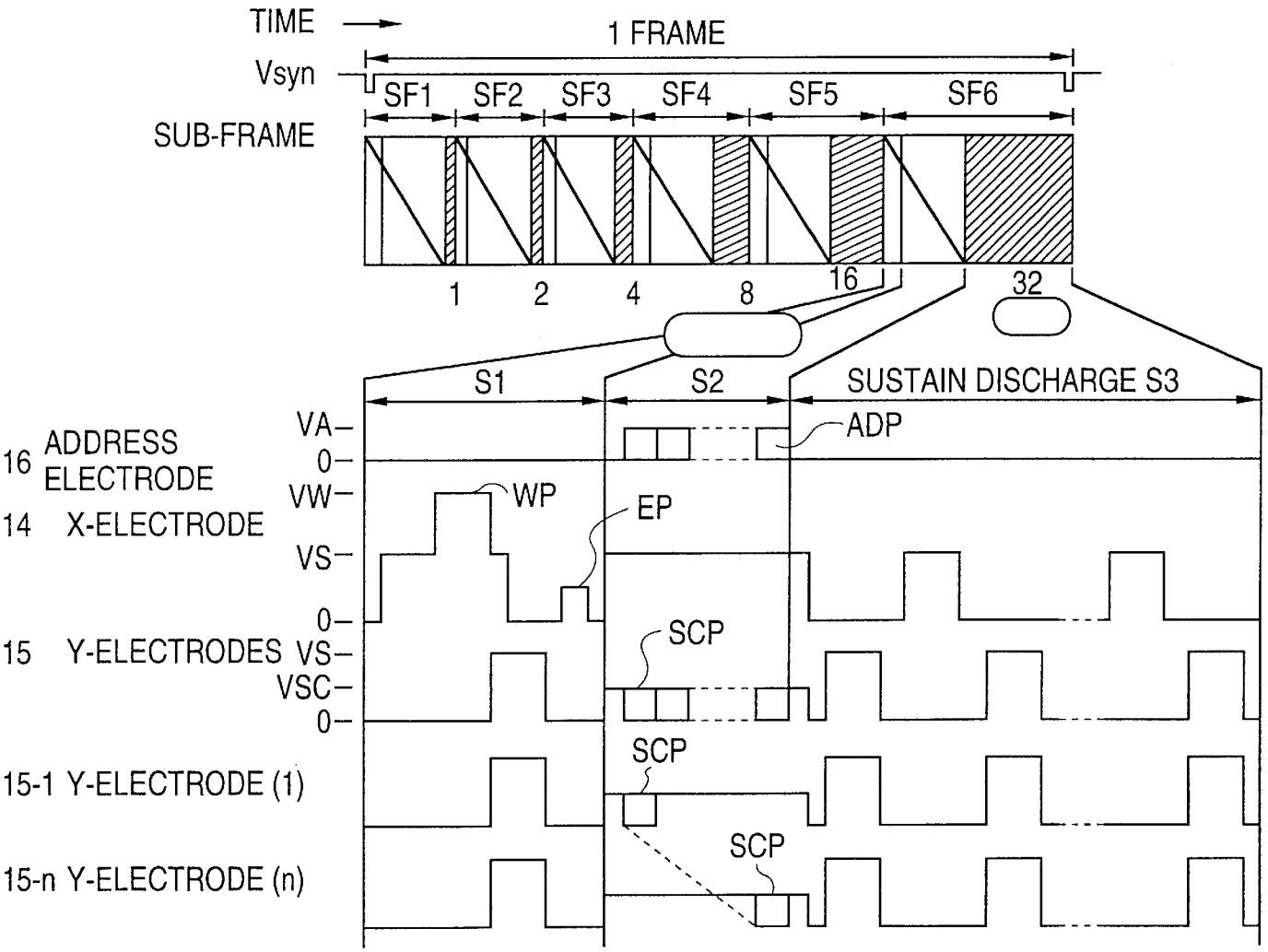
FIG. 37 is a diagram showing the operation of the individual electrodes of a PDP device.

In this embodiment, a vertical synchronization signal to be input is employed to determine the number of sub-frames to form one frame. Once the number of sub-frames is determined, a corresponding value is input to a sub-frame counter. As a result, control of the number of sustained discharge pulses in the sustained discharge period S3 shown in FIG. 37 is controlled.

First, reference numeral 50 denotes a sub-frame selection means 50. A vertical synchronization signal Vsync and a clock signal CLK are input to the sub-frame selection means 50. A timer 501 is cleared at the timing fall of the vertical synchronization signal Vsync, the clock signal CLK is counted, and again at the timing fall of the vertical synchronization signal Vsync, the count value in the timer 501 is latched by a flip-flop 502. The output of the flip-flop 502 is, therefore, a frequency of the vertical synchronization signal Vsync, for example. Then, a sub-frame selection signal consonant with this frequency fF is output by a decoder 503.

The number of sub-frames corresponding to the vertical synchronization signal frequency is determined in advance as is shown in FIG. 3, for example. The number of sub-frames is set to, for example, seven in the vicinity of 60 Hz, which is the common standard established by the NTSC. This means that seven sub-frames are included in a one frame period of 16.7 msec. Thus, when the level of the vertical synchronization signal to be supplied is increased, the number of sub-frames is accordingly reduced. When the correlation shown in FIG. 3 is established, the decoder 503 is formed in consonance with that correlation. In other words, when the detected frequency fF is detected, as is shown in FIG. 3, a corresponding sub-frame selection signal SEL is output. With this sub-frame selection signal SEL, various selection processes are performed later.

The basic idea of the present invention is the changing as needed of the number of sub-frames, depending on the frequency of a supplied vertical synchronization signal. Therefore, when the vertical synchronization signal frequency is detected and the number of sub-frames is determined in the above described manner, an initial value held by the sub-frame counter must be set to a value corresponding to the determined number of sub-frames. The sub-frame counter is a circuit employed to identify the position of a sub-frame currently being driven within one frame period. Particularly, when the intraframe time-division multiplexing method for multiplexing a plurality of sub-frames having different weights is employed as a display device, a weight corresponding to luminance differs for sub-frames depending on their positions. More specifically, the number of sustained pulses provided for the X electrode and Y electrodes during the sustained period differs for each sub-frame. The output of the sub-frame counter is used, for example, to control the number of the sustained pulses.

In FIG. 2, therefore, a sub-frame count set ROM 51 being supplied with a sub-frame selection signal SEL is provided to supply an initial value to the sub-frame counter 52. The sub-frame count set value is shown in FIG. 3, for example. With a frequency of 60 Hz, the number of sub-frames is seven, and the sub-frame count set value is its reciprocal, 1, which is loaded into the sub-frame counter 52. As the count value is incremented by seven, a carry signal CA is output. Incrementing of the count value is repeated in the succeeding frame period.

In FIG. 2, reference numeral 53 denotes a sustained wave count set ROM, to which a count value from the sustain counter 52, the sub-frame selection signal SEL and the luminance signal BC are transmitted as address input, and from which the number of sustained pulses required for the sustained period is output. This output is compared with the contents of an up counter 54 by a comparison circuit 55. When they match, a match signal SE is output.

Reference numeral 57 is a switch with which the number of Y electrodes can be set. The number of Y electrodes is compared with the output of a Y counter 56 for counting the scanning of the Y electrodes by a comparison circuit 58. When the two match, a match signal YE is output.

In the drive control section 381 is provided a waveform ROM 383 from which waveforms employed to drive the X electrode and the Y electrodes are output as a drive signals. An address is supplied by a waveform ROM control circuit 382 for controlling the waveform ROM 383. Then, the X electrode and the Y electrodes are driven by waveform drive signals and signals designating the electrodes to be driven during the reset period, the addressing period and the sustained period.

As is shown in FIG. 37, the sub-frame period for the PDP display device has a reset period S1 during which a writing pulse and an erasing pulse are applied to the X electrode and to all the Y electrodes; an addressing period S2 during which display data are transmitted from the address electrode, and the sub-frame is lit while the Y electrodes are scanned; and sustained period S3 during which sustained pulses, equivalent to weighted values corresponding to the luminances of the sub-frames, are repeatedly applied to the X and Y electrodes. Therefore, the waveform ROM control circuit 382 outputs an address signal ADD, so that during the reset period S1, a writing pulse and an erasing pulse are output from the waveform ROM 383; during the addressing period S2, scan pulses equivalent in number to the count of the Y electrodes are repeatedly output from the waveform ROM 383; and during the sustained period S3, sustained pulses, equivalent to the weighted values, are repeatedly output from the waveform ROM 383.

Figure 4:
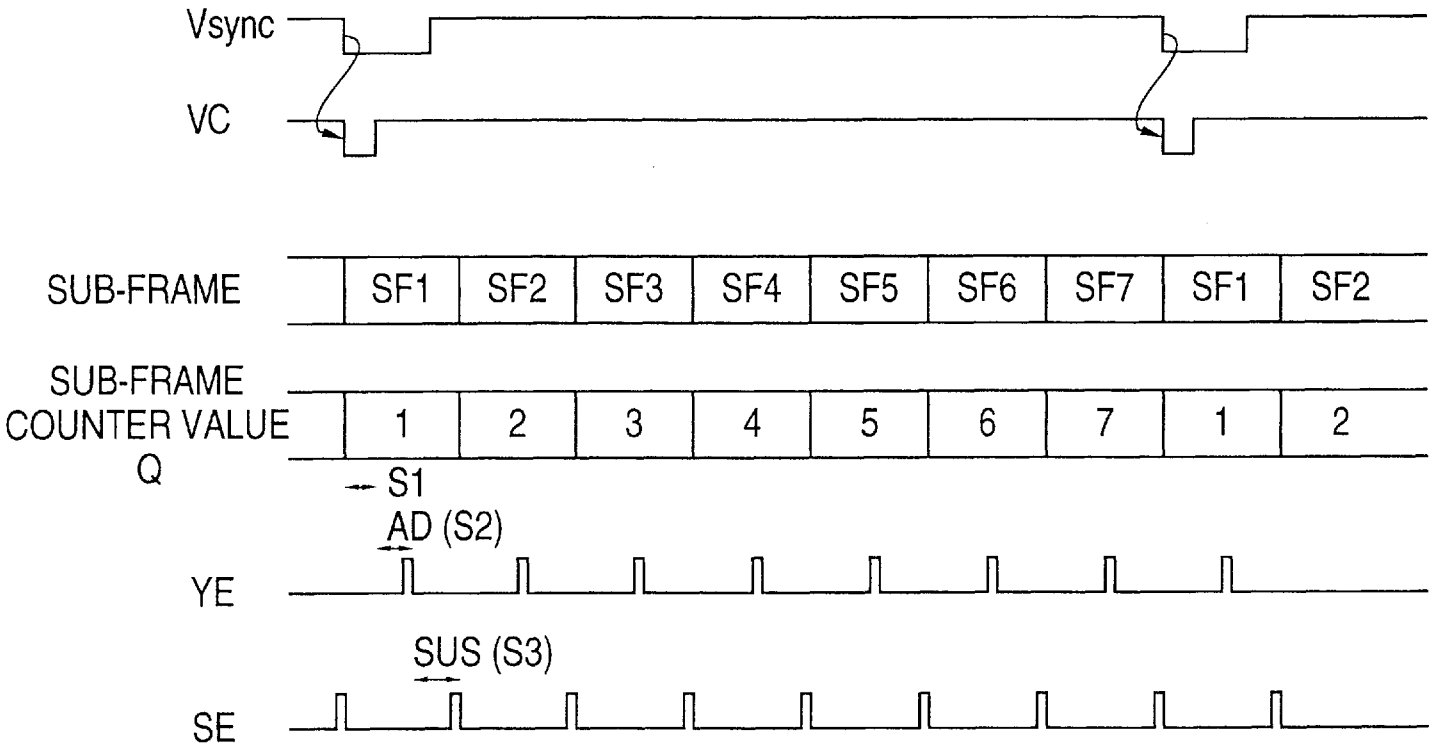
FIG. 4 is a timing chart for the circuit shown in FIG. 2.

The specific operation in FIG. 2 will be explained while referring to the timing chart in FIG. 4. First, a clock VC indicating the start of a frame is generated from the vertical synchronization signal Vsync. Upon the application of the clock VC as a load pulse to the sub-frame counter 52, a sub-frame set value represented in the table in FIG. 3 is loaded from the sub-frame count set ROM 51 into the sub-frame counter 52. The sub-frame counter 52 hereinafter outputs a count value corresponding to the selected number of sub-frames. In FIG. 4 is shown an example for seven sub-frames for a frequency of 60 Hz.

The first period in the sub-frame period is the reset period S1. The waveform ROM control circuit 382 is activated by the clock VC and controls the waveform ROM 383 so as to output therefrom a writing pulse and an erasing pulse during the reset period S1. In the following addressing period AD (S2), the Y counter 56 is reset. Until a count value has been incremented and equals to the number of Y electrodes set by the switch 57, the waveform ROM control circuit 382 controls the waveform ROM 383 so that a scan pulse is repeatedly output therefrom. Specifically, a series of address signals are continuously supplied to the waveform ROM 383 until the match signal YE is received. When the match signal YE is received from the comparison circuit 58, the process is shifted to the succeeding sustained period SUS (S3).

During the sustained period S3, in response to a rest signal, the up counter 54 begins to increment a value. From the sustained wave count set ROM 53 is output a sustain wave count signal SFW, which is introduced by the sub-frame selection signal SEL and address signals for the sub-frame number SFN and the luminance signal BC. As will be described later, the number of sub-frames and the positions of the sub-frames are employed to set the individual sustain wave count (the number of pulses) in the ROM. As the number of sub-frames is increased, many sub-frames having greater weighted values can be located. When the number of sub-frames is small, sub-frames having smaller weighted values are located. Therefore, the number of sustained waves is determined by the selection of the number of sub-frames.

During the sustained period SUS (S3), since the same sustained pulse is repeatedly applied, the waveform ROM control circuit 382 controls the waveform ROM 383 so as to continuously output a sustained pulse from the waveform ROM 383 until the match signal SE is output from the comparison circuit 55. In other words, a series of address signals is supplied to the waveform ROM 383.

When the above described sub-frame periods are repeated by the number of times equivalent to the number of sub-frames, a carry signal CA is output by the sub-frame counter 52, and the operation is halted until the beginning of the next frame period.

[Pseudo gray-scale processing section]

Display data supplied from the system to the display device are ordinarily 8-bit gray scale signals for red, green and blue because 8 bits are sufficient to represent 256 gray scales, and thus so-called natural colors can be produced. If the frequency of a supplied vertical synchronization signal is increased, the number of sub-frames to be driven within one frame must be smaller than eight. Since a plurality of sub-frames are lightened on in a time-division manner, physically, the time is insufficient. Thus, a pseudo-multiple-level gray scale conversion process is performed for an 8-bit display data signal to acquire a display data signal having a small number of bits, so as to initiate a pseudo-representation of 256 gray scales. The pseudo-multiple-level gray scale conversion may also be called a multiple-level gray scale conversion.

Since the pseudo-multiple-level gray scale conversion process is also performed in a copy machine, a facsimile machine or a printer, and is a commonly well known method, a detailed explanation for it will not be given here. An error diffusion method and a dither method are known methods for pseudo-multiple-level gray scale conversion. The error diffusion method is introduced in, for example, "An Adaptive Algorithm for Spatial Greyscale, Floyd and Steiberg, pp. 75–77."

According to this error diffusion method, when 8-bit display data is to be converted to 5-bit display data, gray scales for the lower three bits are lost. Thus, according to the algorithm for the error diffusion method, an error equivalent to the lower three bits is distributed or diffused to adjacent pixels, and when a predetermined number of errors or more is accumulated, a gray scale for the pixel is increased by one level. Referring to an explanatory diagram in FIG. 5, when, for example, the current position of a pixel is F, an error for the pixel F is distributed to the succeeding pixels A', B', C' and D' according to a predetermined ratio. On the other hand, the errors for the preceding pixels A, B, C and D are added to the pixel F according to a predetermined ratio, as is shown by the expression in FIG. 5.

As is described above, once the number of sub-frames is selected, the number of bits to be output from the pseudo-multiple-level gray scale conversion section must be determined in consonance with the selected number of sub-frames. Therefore, when the number of sub-frames is selected in consonance with the vertical synchronization signal frequency, as in the present invention, the processing circuit in the pseudo-multiple-level gray scale conversion section has to be changed.

Figure 6:
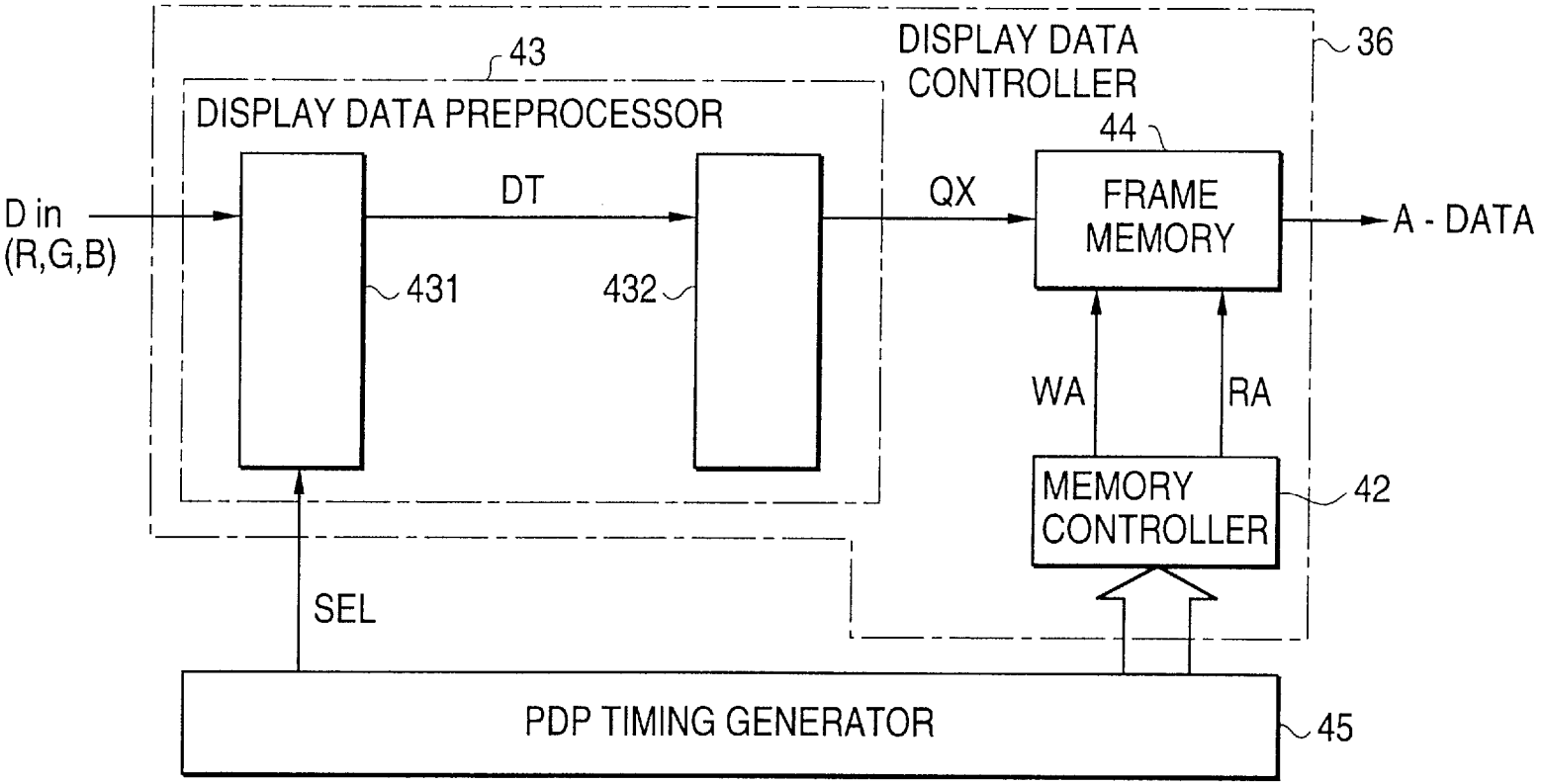
FIG. 6 is a block diagram illustrating a display data preprocessing section.

FIG. 6 is a schematic block diagram illustrating the display data preprocessing section 43 in the display data control section 36. The pseudo-multiple-level gray scale conversion section 431 converts the 8-bit display data Din into display data DT having bits corresponding to the number of sub-frames. A data array conversion section 432 converts the display data DT supplied pixel by pixel into address data QX at least for each line that corresponds to the sub-frame with respect to the array thereof. The address data QX is then written into the frame memory. The frame memory control circuit section 42 receives a writing address WA and a reading address RA and transmits address data A-DATA to the address driver in the optimal order of the sub-frames.

Figure 7:
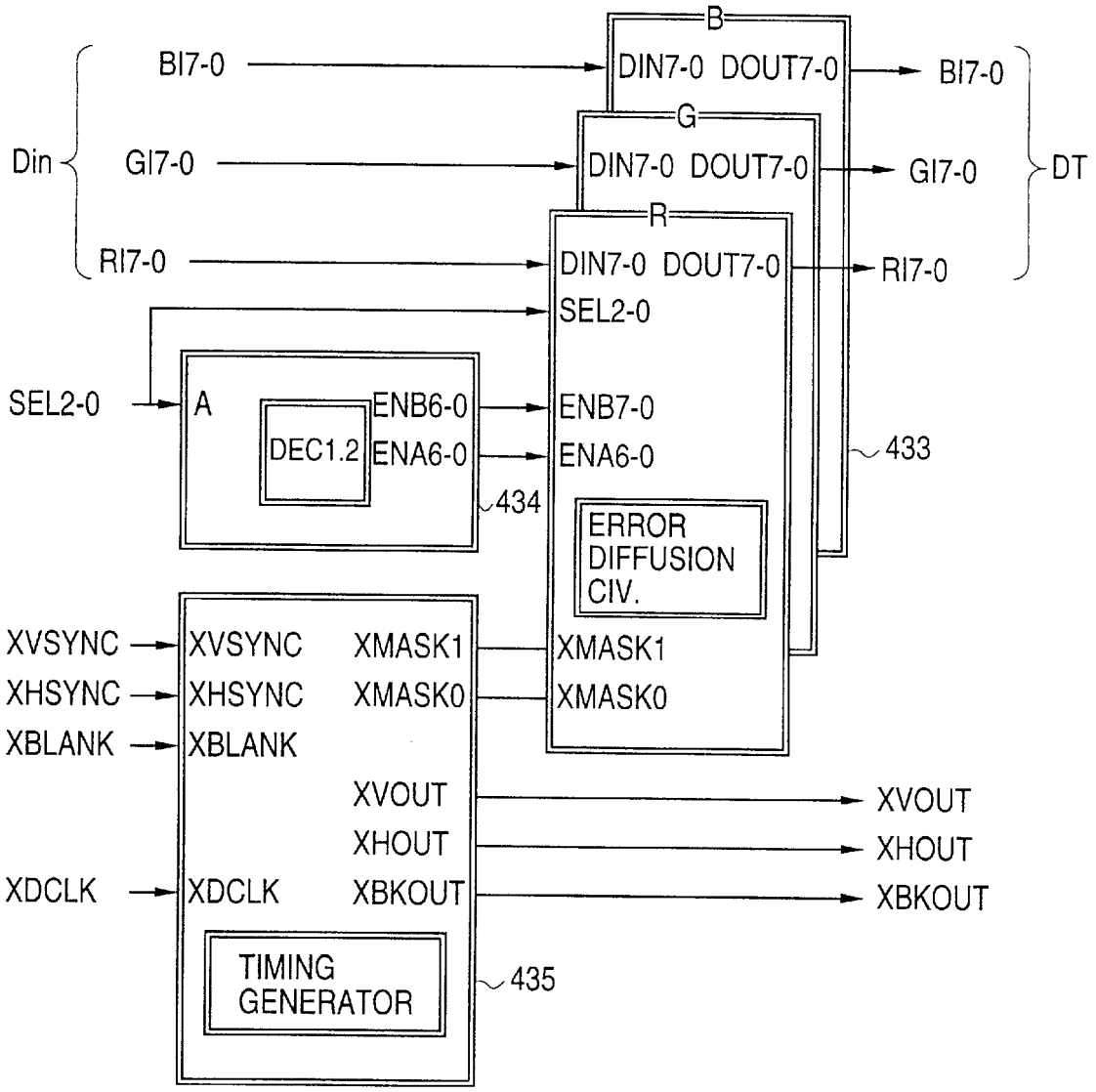
FIG. 7 is a diagram illustrating the general structure of a pseudo-multiple-level gray scale conversion section.

The arrangement of the pseudo-multiple-level gray scale conversion section 431 will now be described while referring to FIGS. 7, 8 and 9. FIG. 7 is a diagram illustrating the general structure of the pseudo-multiple-level gray scale conversion section 431 comprising: an error diffusion circuit 433, for receiving the display data Din and outputting the display data DT obtained by pseudo-multiple-level gray scale conversion; a decoder circuit 434, for producing decoded control signals ENA and ENB in response to the sub-frame selection signal SEL and for transmitting the control signals to the error diffusion circuit 433; and a timing generation section 435. The error diffusion circuit 433 includes an error diffusion arithmetic operation circuit 436 and an error addition circuit 437, as is shown in FIG. 8.

Figure 8:
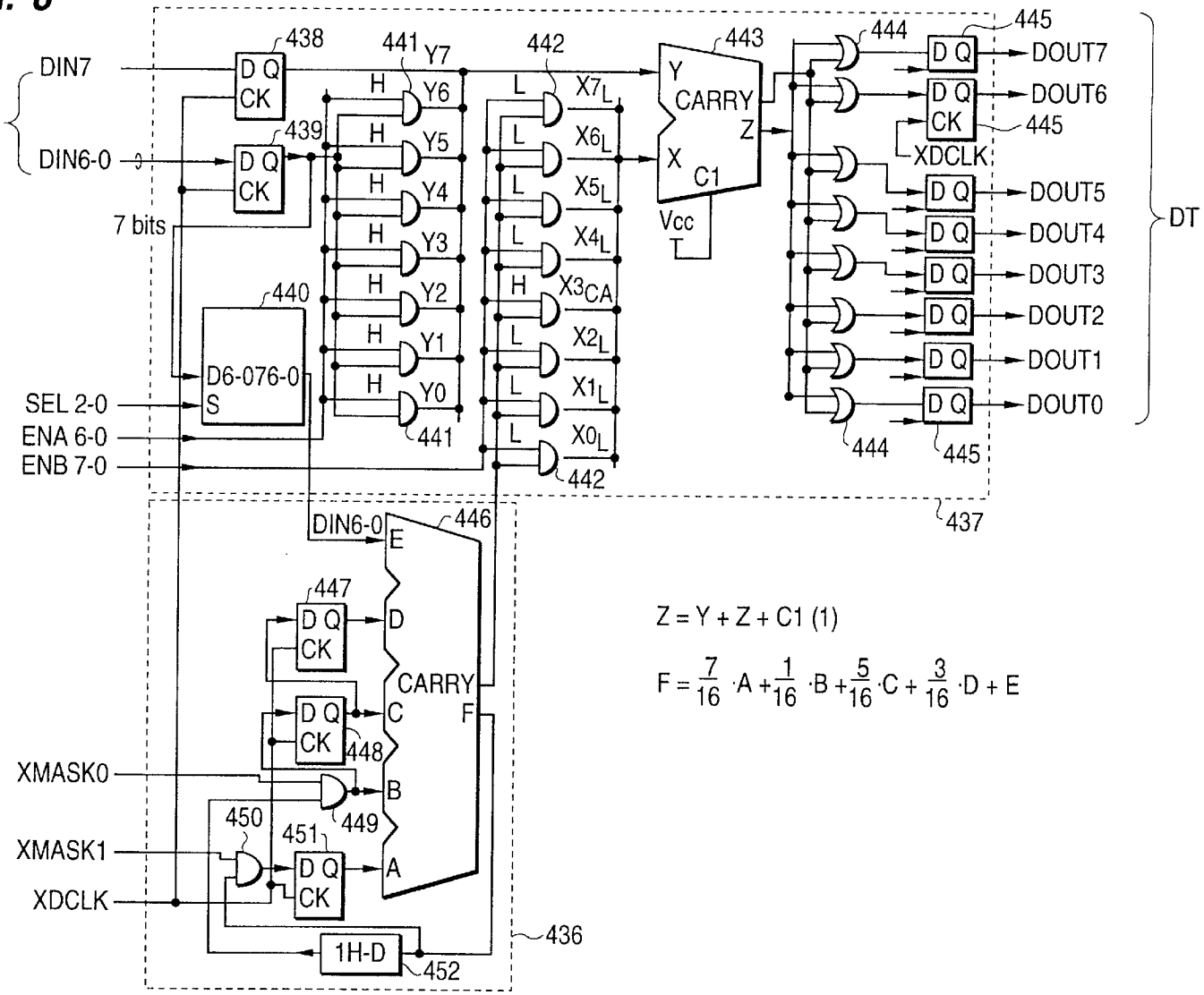
FIG. 8 is a detailed circuit diagram illustrating the pseudo-multiple-level gray scale conversion section.

In FIG. 9 are shown truth tables for the control signals ENA and ENB output by the decoder circuit 434 as FIG. 9A, 913 and a truth table as FIG. 9C for an error extraction section 440 in the error addition circuit 437 in FIG. 8.

The operation of the pseudo-multiple-level gray scale conversion section 431 by using the error diffusion method will now be explained while referring mainly to the block diagram in FIG. 8. First, of an input 8-bit display signal Din, lower bits Din 6-0, which have a probability to be an error, are supplied to the error extraction section 440 and an AND circuit group 441 via a delay flip-flop 439. The most significant Din 7 is transmitted directly to the addition circuit 443. In consonance with the sub-frame selection signal SEL, the error extraction section 440 transmits the display data Din 6-0 to an addition circuit 446 of the error diffusion arithmetic operation circuit 436 according to the theory shown in Table 3 in FIG. 9.

Figure 5:
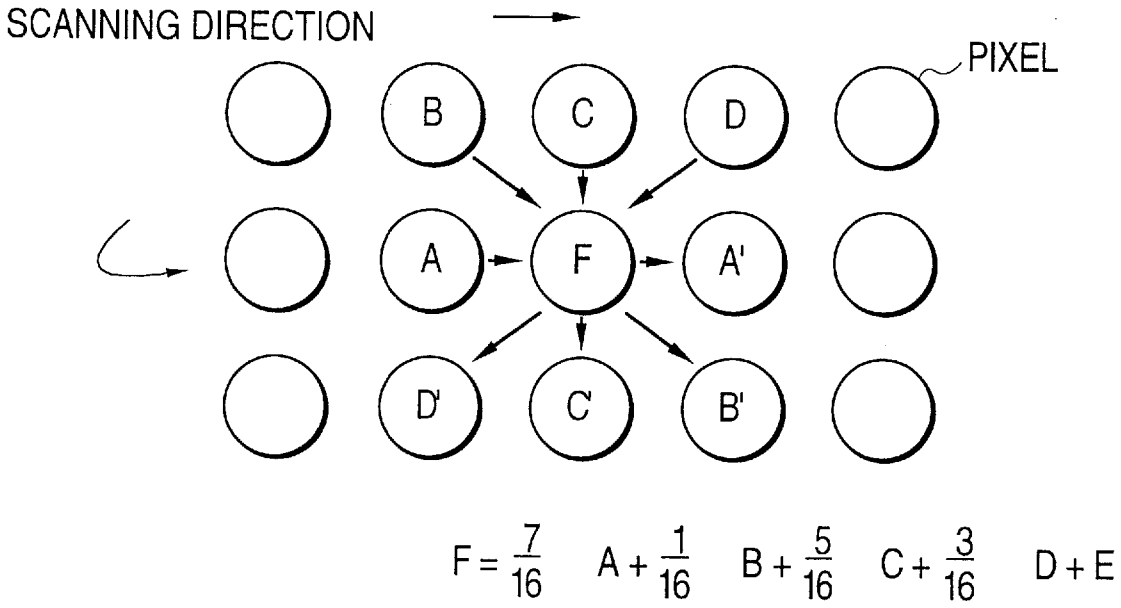
FIG. 5 is a diagram for explaining an error diffusion method.

A case for pseudo-multiple-level gray scale conversion from 8-bit input display data into 5 bits display data will now be explained. If the number of sub-frames is equal to 5 bits, the sub-frame selection signal SEL is (H, L, L). Referring to Table 3 in FIG. 9C, therefore, three lower bits D2, D1 and D0 are supplied as error data Y to the error diffusion arithmetic operation circuit 436. In other words, this corresponds to the case where, as is shown in FIG. 5, the pixel F supplies an error to its own pixel. In the error diffusion arithmetic operation circuit section 436, the errors of the other pixels, A, B, C and D, are also transmitted to the addition circuit 446 by the delay flip-flop circuits 447, 448 and 451, a row delay circuit 452, and AND circuits 449 and 450. The output value F of the addition circuit 446 is so calculated as to establish the expression shown in FIG. 8.

On the other hand, in the error addition circuit 437, according to the control signal ENA from the decoder 434, a display data signal of upper bits which are not regarded as an error is passed through the AND circuit group 441 and is transmitted to the Y terminal of the addition circuit 443. If the display signal has five bits, as in Table 1 in FIG. 9A, the upper bits Din 6, 5, 4 and 3 are passed through the AND circuit 441 according to an H-level control signal ENA, while the lower bits are masked by an L-level control signal ENA.

A carry signal is added as the X value of the addition circuit 443 to the bit signal by the AND circuit 442. More specifically, when the accumulated value of the errors E of its own and the errors of the adjacent pixels A, B, C and D exceeds a predetermined value, the addition circuit 446 outputs an H level carry signal. This carry signal value must be added to the least significant bit of the 5-bit signal to correct luminance. As is shown in Table 2 in FIG. 9B, therefore, the decoder 434 generates a control signal ENB so that a carry signal can be reflected to the least significant bit X3. Then, the carry signal value that accompanies the accumulation of the errors is added to the upper bit display data input by the addition circuit 443, and the resultant signal is transmitted as a Z signal through the delay flip-flop 4445. In this example, only the upper five bits of output signal DT serve as valid display data.

As is shown in FIG. 9, in consonance with the number of bits output from the pseudo-multiple-level gray scale conversion section 431, the same sub-frame selection signal SEL is employed to produce the control signal (see FIG. 9), which allows the internal arithmetic operation circuit in the pseudo-multiple-level gray scale conversion section 431 in FIG. 8 to perform arithmetic operations as needed. Therefore, even when the number of sub-frames are changed in consonance with the vertical synchronization signal frequency, the pseudo-multiple-level gray scale conversion section can also perform arithmetic operations, as needed.

The error diffusion arithmetic operation circuit 436 is designed by using an ordinary circuit to perform commonly known error diffusion arithmetic operations, and a detailed explanation for the circuit 436 will not be given.

[Display data conversion section]

Figures 38, 39:
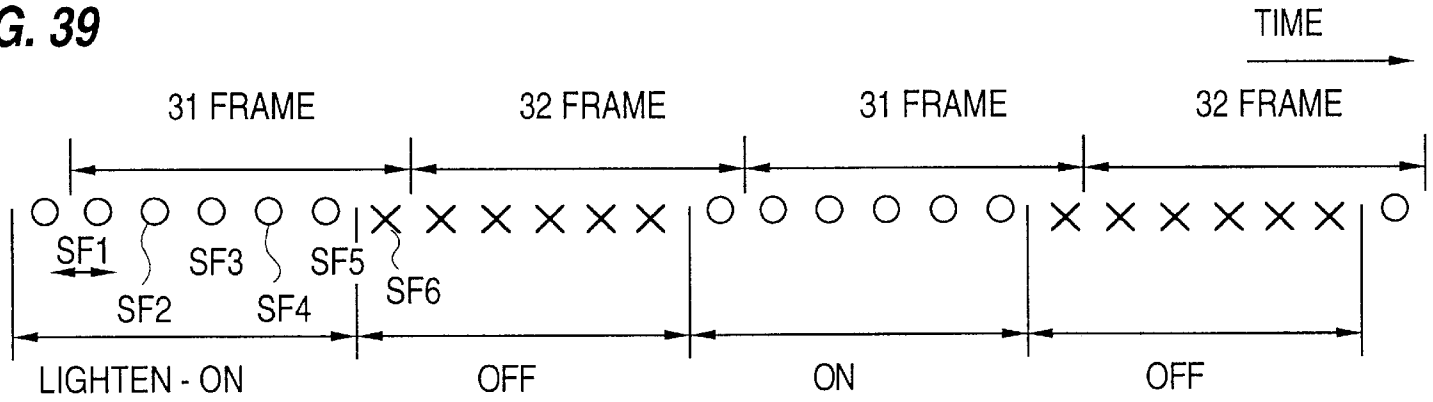
FIG. 38 is a diagram showing an example structure of 64-gray scale sub-frames.
FIG. 39 is an explanatory diagram for a conventional example.
Figure 40:
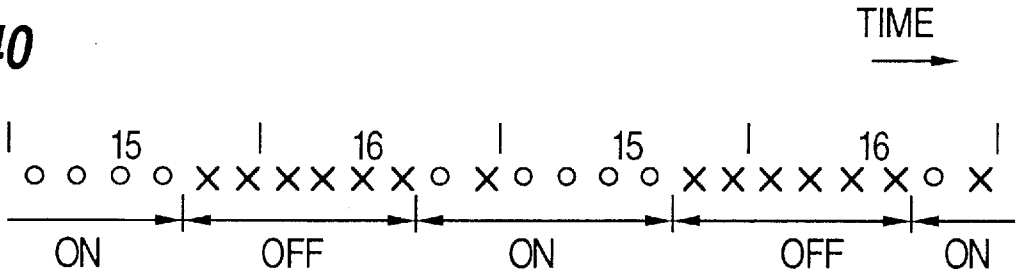
FIG. 40 is an explanatory diagram for another conventional example.

The control involving the use of the intraframe time-division multiplexing method is performed to provide a multiple-level gray scale display. As is shown in FIG. 39, if, for example, five sub-frames are used to alternately display gray scale levels 31 and 32, in appearance, the state where all the sub-frames are lit (ON) and the state where all the sub-frames are not lit (OFF) are alternately repeated, and this causes flickering. Further, as is shown in FIG. 40, when five sub-frames are employed to alternately display gray scale levels 15 and 16 in the same manner, the same phenomenon occurs.

To resolve the problem of flicker, the present inventors proposed one display control method called the duplicated subframe method in, for example, Japanese Patent Application No. Hei 6-264244 and its corresponding U.S. patent application Ser. No. 368,002. According to the duplicated subframe method, the display data obtained after the pseudo-multiple-level gray scale conversion is further divided, and is converted into one set of sub-frame data that has a plurality of sub-frames having the same weighted values, for example. Then, the separated sub frames in a set are rearranged in the optimal order with which the occurrence of flicker and of false colored contours is prevented.

Figure 41:
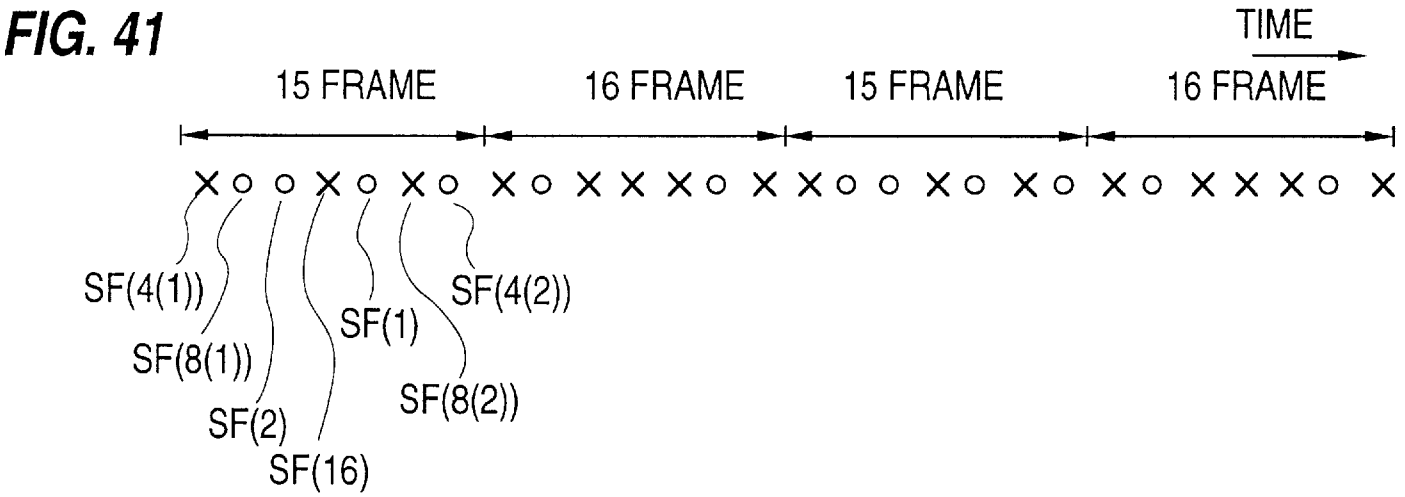
FIG. 41 is a diagram for explaining a duplicated subframe method.

In FIGS. 11, 12 and 13 are shown specific examples of conversion tables. For example, in FIG. 12 is shown a conversion table for seven sub-frames. In this example, gray scale levels 0 through 43 are converted into sets of seven sub-frames having weighted values of (1, 2, 4, 8, 8, 16). The order for displaying the sub-frames is set to (4, 8, 2, 16, 1, 8, 4) and the luminance is dispersed along the time axis. In other words, a sub-frame having a high luminance is located in the center and a plurality of sub-frames having the same luminance are located separately. As a result, when, for example, the sub-frames at gray scale level 15 and 16 are alternately displayed, the sub-frames to be lit and the sub-frames not to be lit are dispersed, as is shown in FIG. 41, so that the phenomenon that causes flicker, as is shown in FIGS. 39 and 40, can be prevented.

Once the number of sub-frames to be displayed is determined, the optimal conversion table for the selected number of sub-frames is also selected in advance. For example, the conversion table in FIG. 11 is selected for eight sub-frames; the conversion table in FIG. 12 is selected for seven sub-frames; and the conversion table in FIG. 13 is selected for six sub-frames. Therefore, when the number of sub-frames is selected and an optimal conversion table is designated, the number of bits for display data output from the pseudo-multiple-level gray scale conversion section is also designated at the same time. The conversion tables in FIGS. 11, 12 and 13 are merely examples, and it is apparent that the present invention is not limited to these conversion tables.

Figure 10:
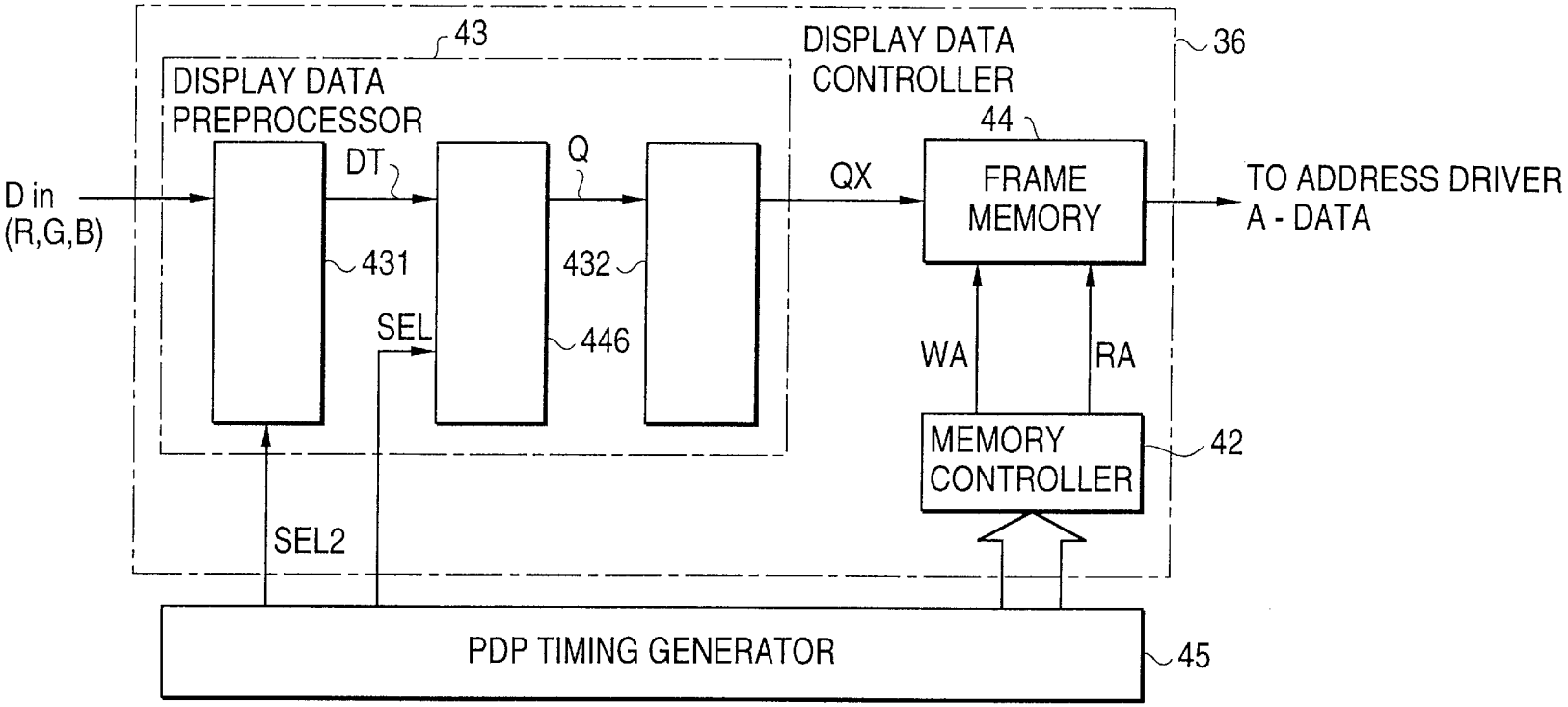
FIG. 10 is a block diagram illustrating a display data preprocessing section.

FIG. 10 is a block diagram illustrating the display data preprocessing section 43 that has a display data conversion section 446 for performing the duplicated subframe conversion. The conversion operation, for inputting an 8-bit display data signal Din to the pseudo-multiple-level gray scale conversion section 431 and for outputting the display data signal DT obtained by conversion, was previously explained. In consonance with the conversion table shown in FIG. 11, 12 or 13, the display data conversion section 446 converts the display data DT into display data Q that corresponds to a sub-frame, and outputs the display data Q. The display data conversion section 446 for performing the duplicated subframe conversion is theoretically constituted by memory, such as a look-up table. Thus, the display data DT serves as an input address for the memory.

As is apparent from the above described explanation, when the number of sub-frames is altered in consonance with the vertical synchronization signal frequency, data in the conversion table of the display data conversion section 446 should accordingly be changed. Further, the number of bits for an output signal of the pseudo-multiple-level gray scale conversion section 431 also has to be changed in consonance with the number of bits for the input address DT for the conversion table.

In the embodiment shown in FIG. 10, the sub-frame selection signal SEL is supplied as an additional input address signal to the display data conversion section 446. The display data conversion section 446, therefore, stores data for conversion tables in FIGS. 11, 12 and 13 in the memory in an amount at least the equivalent of the number of sub-frames to be changed. According to the sub-frame selection signal SEL, the data for a conversion table to be employed is changed.

According to the example shown in FIG. 12, the number of bits of the display data DT of the pseudo-multiple-level gray scale conversion section 431 is 6 as the gray scale level is 64. A control signal, etc., are produced by the circuit as was previously explained in FIGS. 7, 8 and 9, so that the output display data DT has 6 bits. When the display data conversion section 446 is provided, the number of the sub-frames do not always match the number of bits for the output display data of the pseudo-multiple-level gray scale conversion section 431. Specifically, as is shown in the conversion tables in FIGS. 11, 12 and 13, the number of bits for the display data signal DT, which is obtained by pseudo-multiple-level gray scale conversion and is input to the display data conversion section 446, is smaller than the number of sub-frames. Therefore, the sub-frame selection signal SEL should be corrected according to the conversion table that is selected in advance, and the resultant signal SEL2 has to be transmitted to the pseudo-multiple-level gray scale conversion section 431. In this case, for example, only the sub-frame selection signal SEL from the decoder 503 in FIG. 2 and the corrected signal SEL2 need be output. Further, instead of correcting the sub-frame selection signal SEL, only the arrangement of the decoder 434 in FIG. 7 need be changed.

Since the weighted values of the sub-frames are also changed in consonance with a selected conversion table, it is also necessary to change the number of waves in the sustained count set ROM 53, explained when referring to FIG. 2. In either case, when the number of sub-frames is selected in consonance with the vertical synchronization signal frequency, the display data conversion table is selected according to the number of sub-frames, the number of bits to be output from the pseudo-multiple-level gray scale conversion section 431 is selected, the sustained wave count is selected, and further the initial value of the sub-frame counter 52 is also selected. As a result, even when the vertical synchronization signal frequency is increased more for multi-scanning, the display device can flexibly cope with the condition.

The improvement for the reduction in the necessary capacity required for a look-up table in the duplicated subframe conversion section will now be described as a second embodiment.

[General arrangement of display device]

Figure 14:
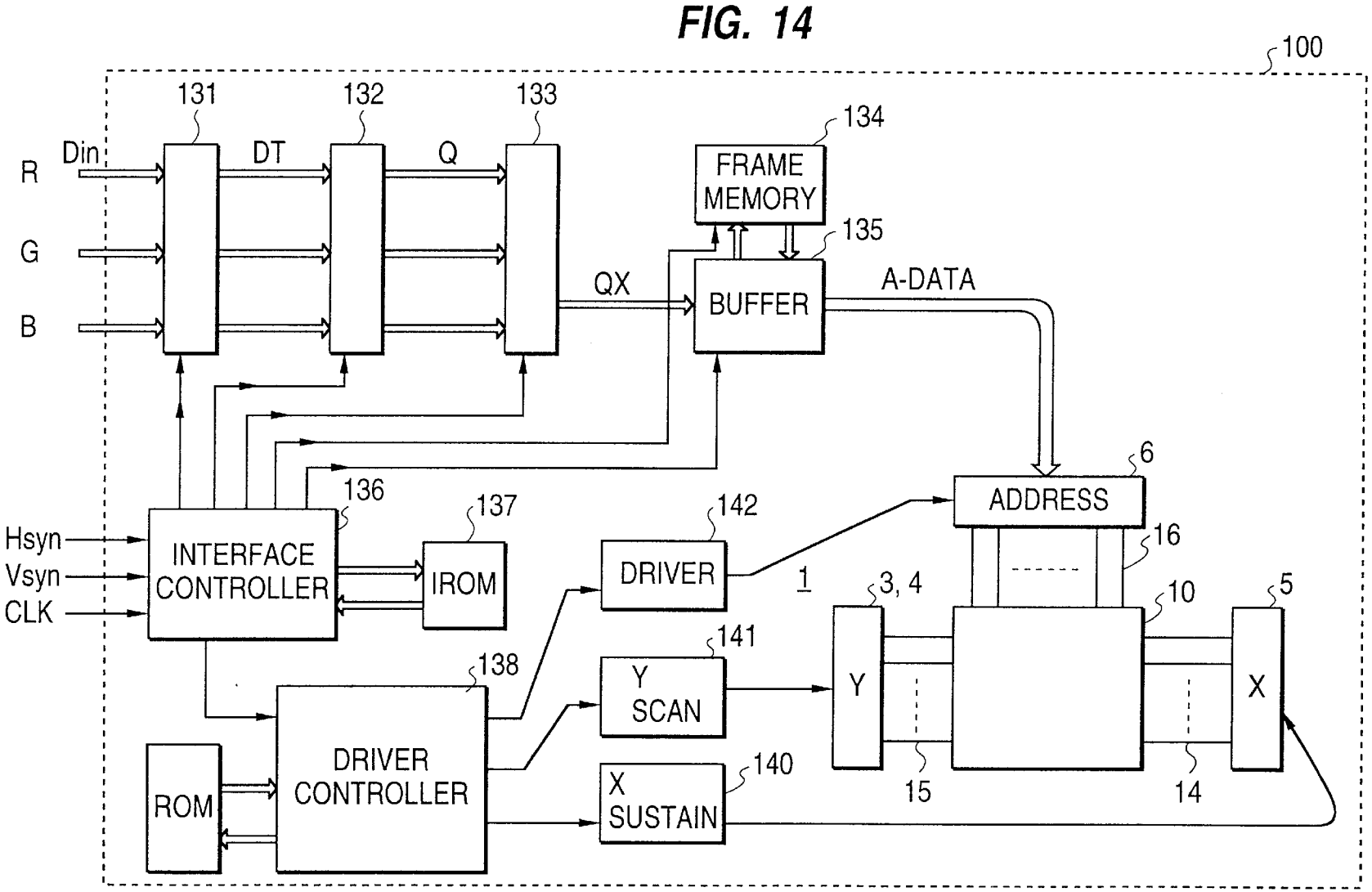
FIG. 14 is a diagram illustrating the general structure of a flat panel display device.

FIG. 14 is a diagram illustrating the general arrangement of a flat panel display device 100 according to the second embodiment of the present invention. Although a flat panel display device is employed as a PDP display device for the following explanation, the present invention can be applied not only for the PDP display device but also for other ordinary flat panel display devices, such as LCD display devices.

In FIG. 14, reference numeral 10 denotes a display panel section; 3 and 4, Y drivers for driving Y electrodes 15; 5, an X driver for driving an X electrode 14; and 6, an address data driver for driving an address electrode 16. The arrangement is the same as that in FIG. 35.

A pseudo-multiple-level gray scale conversion section 131, a duplicated subframe conversion section 132 and a data array conversion section 133 correspond to a so-called preprocessing section for display data. Input display data Din is an 8-bit signal corresponding to red, green or blue (RGB), and RGB are display data for 256 gray scale levels. The input display data Din is converted by the pseudo-multiple-level gray scale conversion section 131 into a signal DT, which has a lower resolution than 256 but can represent 256 gray scale levels.

Since the pseudo-multiple-level gray scale conversion is employed for copy machines and printers and is thus a well known technique, a detailed explanation for it will not be given here. Actually the conversion is already explained in FIGS. 5 and 8. To explain it briefly, this conversion is a process wherein, for example, of an 8 bit set of input display data, a 64 gray scale count signal using the upper six bits is employed as a display signal, and a signal using the lower two bits indicating a slight gray scale difference is corrected by a given algorithm so as to reflect the gray scale data at nearby pixels.

The display data DT, a multiple-gray scale signal obtained by pseudo-multiple-level gray scale conversion (131), is converted by the duplicated subframe conversion section 132 into data Q of an appropriate sub-frame combination in order to prevent the occurrence of flicker and false colored contours. Since the input order for the resultant data Q corresponds to the pixel order on a display screen, a data array conversion section 133 converts the received data Q to data that correspond to sub-frames for each line (Y electrode line), and outputs the resultant data QX.

The thus obtained display data QX is temporarily stored in a frame memory 134 via a frame memory input/output control buffer 135. Address data A-DATA is supplied to an address data driver 6 in consonance with a control signal from an interface control circuit 136.

The drive process is entirely controlled by a driver control circuit 138. In this embodiment, upon receipt of a timing control signal from the interface control circuit 136, the drive control circuit 138 generates an internal sequence for driving a display panel; reads as needed a drive waveform, from a drive waveform ROM 139, that is programmed in advance; and drives the drivers 3 and 4, 5 and 6 through an X sustain drive circuit 140, a Y scan drive circuit 141, and an address drive circuit 142, respectively.

The interface control circuit 136 receives a horizontal synchronization signal Hsync, a vertical synchronization signal Vsync, and a clock signal CLK. The interface control circuit 136 therefore controls all the operating timings in the display device 100. For example, the synchronization of frames is controlled by using the vertical synchronization signal Vsync; and the timing at which RGB input display data Din corresponds to which pixel on a display screen, is controlled by using the vertical synchronization signal Vsync, the horizontal synchronization signal Hsync and the clock CLK. An initialization ROM 137 is provided in which the setting of the number of sub-frames SF, the selection of a duplicated subframe conversion table, etc., are stored before shipment from the factory. The operations of the interface control circuit 136, etc., are performed in consonance with the stored initial values in ROM 137.

As is described above, the interface control circuit 136 and the drive control circuit 138 serve as a display control section in order to display an image of a multiple-level gray scale on the display panel section 10.

[Duplicated subframe method]

In FIG. 15 is shown an example conversion table according to the duplicated subframe method. Although, as previously described, the duplicated subframe method is explained in detail in the patent specifications already filed by the present inventors, the duplicated subframe method will be briefly described.

To prevent the occurrence of flicker and false colored contours, as is explained for FIGS. 39 and 40, a sub-frame having a high weighted value is divided, and a plurality of sub-frames are rearranged in the optimal display order so as to form an optimal combination for each gray scale level. Seven frames are employed for an example conversion table shown in FIG. 15, unlike the example in FIG. 37. As is shown in FIG. 15, the order for displaying the sub-frames for this conversion table is 4, 8, 2, 16, 1, 8 and 4, with respect to the weighted values. An optimal combination is set in advance for each gray scale of 0 to 43. In the columns on the right half in FIG. 15, circles are drawn to designate which sub-frames are to be lit. The sub-frames are displayed in order from the left to the right.

As previously described, an input 8-bit display data signal Din having 256 gray scale levels is converted into a signal having 44 gray scale levels by the pseudo-multiple-level gray scale conversion section 131. The display data DT, obtained after the multiple-level gray scale conversion and having 0 to 43 gray scales, are represented by the 6-bit signals DT2 to DT7. In consonance with the conversion table in FIG. 15, the duplicated subframe conversion section 132 in FIG. 14 converts the input data DT2-7 into conversion data Q that represent a combination of seven subframes. Therefore, the obtained data Q has the seven bits Q1 through Q7.

The conversion table in FIG. 15 is employed and the display input data is converted to a combination of subframes for which the weighted values are 1, 2, 4, 4, 8, 8 and 16 and for which the display order is 4, 8, 2, 16, 1, 8 and 4. When the gray scale 15 and the gray scale 16 explained in FIG. 40 are alternately displayed, the result is as shown in FIG. 41. As is apparent from a comparison of FIGS. 40 and 41, when conversion is performed by the duplicated subframe method, there are a plurality of sub-frames having the same gray scale weighted value. In addition, since subframes to be turned off are dispersed along the time axis, the phenomenon as explained in FIG. 40 rarely occurs. In the index for the data Q, an upper bit corresponds to a greater weighted value of a sub-frame. Therefore, conversion data Q corresponding to the sub-frames having the weighted values 16, 8 (2), 8 (1), 4 (2), 4 (1), 2 and 1 are Q7, Q6, Q5, Q4, Q3, Q2 and Q1, respectively.

As is apparent from the conversion table according to the duplicated subframe method shown in FIG. 15, the subframes having weighted values of 32, 16, 8 and 4 are separated into one sub-frame having weighted value 16, two sub-frames having weighted value 8, and two sub-frames having weighted value 4. In other words, in spite of the seven sub-frames, there are two sub-frames having weighted values 4 and 8, and no sub-frames having weighted values 64 and 32. The combination of sub-frames is determined based on the idea that by taking the driving ability of the display panel into consideration, the number of sub-frames displayed during one frame period can be determined, and the best combination of sub-frames in consonance with the determined number can be obtained. Therefore, if only seven sub-frames can be driven in one frame period, the number of sub-frames is determined to be seven, and the optimal combination of seven sub-frames is determined so as to prevent the occurrence of flicker and false color contours.

Assume that, as is shown in FIG. 15, the combination of sub-frames having the weighted value order 4, 8, 2, 16, 1, 8 and 4 is appropriate. Then, only gray scale levels 0 through 43 can be represented, and the pseudo-multiple-level gray scale conversion is performed in order to display 256 gray scales while it is possible to display only 44 gray scale levels. Thus, depending on the ability of a display panel, the number of sub-frames can be increased to increase the number of gray scale levels. Further, when only six subframes can be arranged in a single frame, the number of gray scale levels is reduced to correspond to them.

[Improvement of duplicated subframe conversion section]

When the conversion table in FIG. 15 is to be realized simply by using a look-up table, such as a semiconductor memory, data DT2 to DT7 are supplied as input address to the memory, and data Q1 to Q7 are output according to 44 different conversion tables. In this process, a plurality of conversion tables must be prepared, and as their number is increased, the required memory capacity will become enormous.

The present inventors, however, analyzed the conversion table in FIG. 15 and found that the least significant bits DT2 and DT3 on the input side are not objects for duplicated subframe conversion and are the same as the least significant bits Q1 and Q2 on the output side. In other words, when a "1" is entered in the column positions with 0's for the output side data Q, and a "0" is entered in the column positions without 0's, it can be seen that both data signals on either side are the same 2-bit signals.

In this invention, therefore, the bits (DT2 and DT3 in the example in FIG. 15), which are not employed as targets for duplicated subframe conversion, are not regarded as entries of the conversion table. Only the bits (DT4 through DT7 in the example in FIG. 15) employed as targets for duplicated subframe conversion are entered in the conversion table. The output data Q7, Q6, Q5, Q4 and Q3 obtained by conversion are synthesized with the input bits DT2 and DT3, which were not employed for duplicated subframe conversion.

Figure 16:
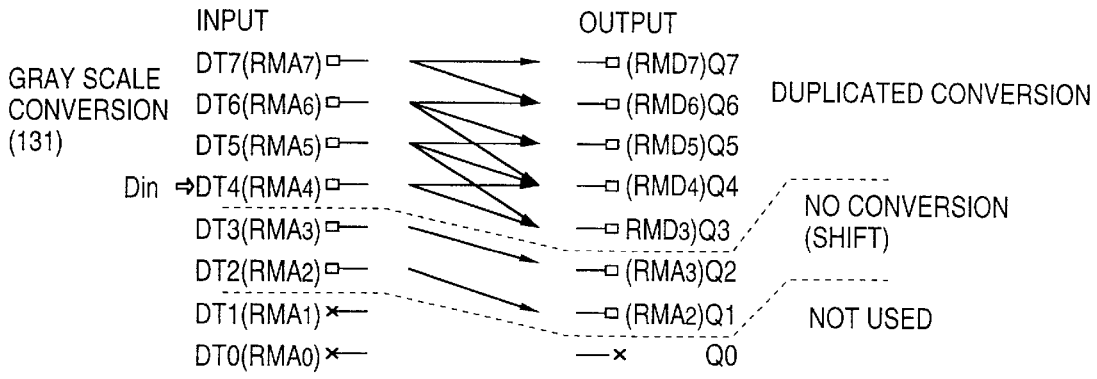
FIG. 16 is a schematic diagram showing duplicated sub-frame conversion according to the embodiment of the present invention.

This process is as shown in a schematic diagram FIG. 16 for the duplicated subframe conversion according to the embodiment of the present invention. Input 8-bit display data Din is corrected for by the pseudo-multiple-level gray scale conversion section 131 to produce the data DT0 through DT7. The data DT2 through DT7 are 6-bit signal data representing the gray scale levels from 0 through 43. As is described above, the input signals DT4, DT5, DT6 and DT7 are regarded as targets for duplicated subframe conversion, and data signals obtained after conversion, Q3, Q4, Q5, Q6 and Q7, are transmitted as the output of a look-up table. The input signals DT2 and DT3, which are not employed for conversion, are shifted in the lower direction and output as output signals Q1 and Q2. Finally, the display data Q1 through Q7 indicating the lightening on and off of seven sub-frames are supplied to the data array conversion section 133.

In the above described example, the input signal is saved on by two bits, and a memory area is reduced to one fourth its original size. It is required that an input bit to be a target for duplicated subframe conversion be determined in consonance with the types of conversion tables. However, since at least the least significant bit among the valid bits represent the minimum unit of a gray scale level, it should not be subject to the duplicated subframe conversion. Although the weighted value of the second lowermost bit (DT3) in the above example is 2, the weighted value "2" can be divided and duplicated over two weighted values of "1." As the presence of a sub-frame having a great weighted value causes flicker and false colored contours, theoretically, the input lower bits are not subject to the duplicated subframe conversion, and the upper bits are regarded as targets for conversion. Further, only arbitrary, discontinuous bits of the upper bits may be employed for the duplicated subframe conversion.

Figure 17:
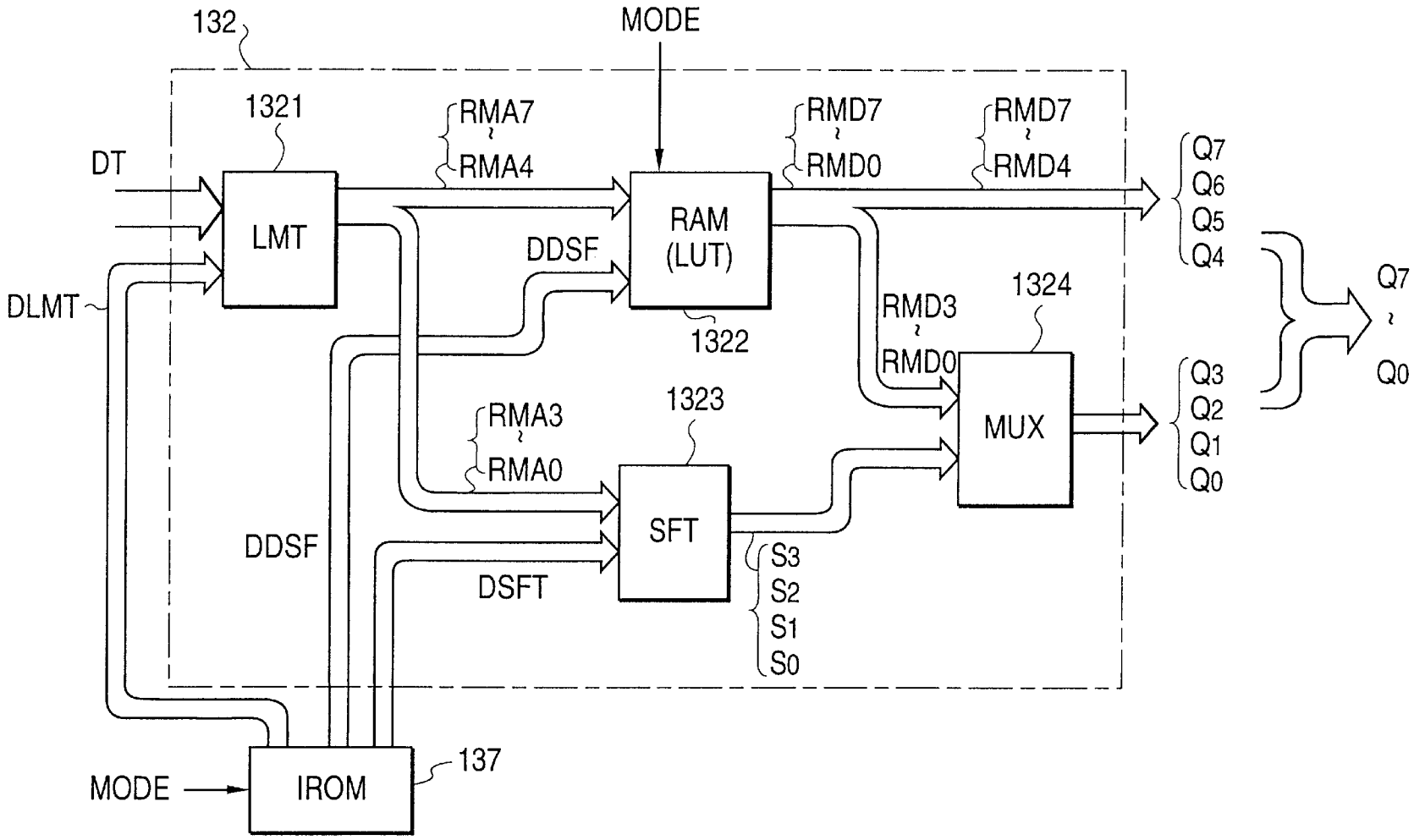
FIG. 17 is a diagram illustrating the internal structure of a duplicated subframe conversion section.

The internal structure of the duplicated subframe conversion section 132 will now be explained. In FIG. 17 is shown an example arrangement of the duplicated subframe conversion section 132 according to the embodiment of the present invention. In this example, the input data DT is supplied through a limiting circuit 1321 to a random access memory (RAM) 1322 consisting of a look-up table (LUT), which is a conversion table section. From output RMA7 through RMA0 of the limiting circuit 1321, the upper 6 bits are valid; the upper four bits RMA7 through RMA4 are subject to the conversion, and are input to the RAM 1322. The lower bits RMA3 through RMA 0, which are not subject to the conversion, are input to a shifting circuit 1323.

The valid upper four bits among RMD7 through RMD0 are output from the RAM 1322 as data Q7, Q6, Q5 and Q4 for instructing the ON/OFF of sub-frames. The lower bits RMA3 through RMA0 being not subject to the conversion are shifted one bit in the lower direction by a shifting circuit 1323 to obtain shift outputs S3 through S0. The lower four bits RMD3 through RMD0 are then synthesized with the shift outputs S3 through S0 by a multiplexing circuit 1324.

Specifically, the valid shift outputs S3 through S0 are preferentially output as data Q3 through Q0.

The shifting circuit 1323 is provided because the order for displaying gray scales should be matched, as is described while referring to FIG. 16. Since the shift value differs from duplicated subframe conversion tables, the shift value is set by a value of a shift instruction signal DSFT from the initialization ROM 137. More specifically, if the number of bits of the converted output RMD is greater than the number of bits of address RMA input to the memory 1322 of the conversion table section, the RMA is shifted by a value equivalent to the difference between the number of bits. In the conversion table in FIG. 15, a shift value is 1.

As is described above, the shifting circuit 1323 and the multiplexing circuit 1324 are employed to synthesize the multiple-level gray scale signal RMA3-0 being not subject to the conversion and the converted output signal RMD3-0 being not subject to the conversion in consonance with their gray scale levels. The shifting circuit 1323 and the multiplexing circuit 1324 serve as a synthesizing section.

Figure 18:
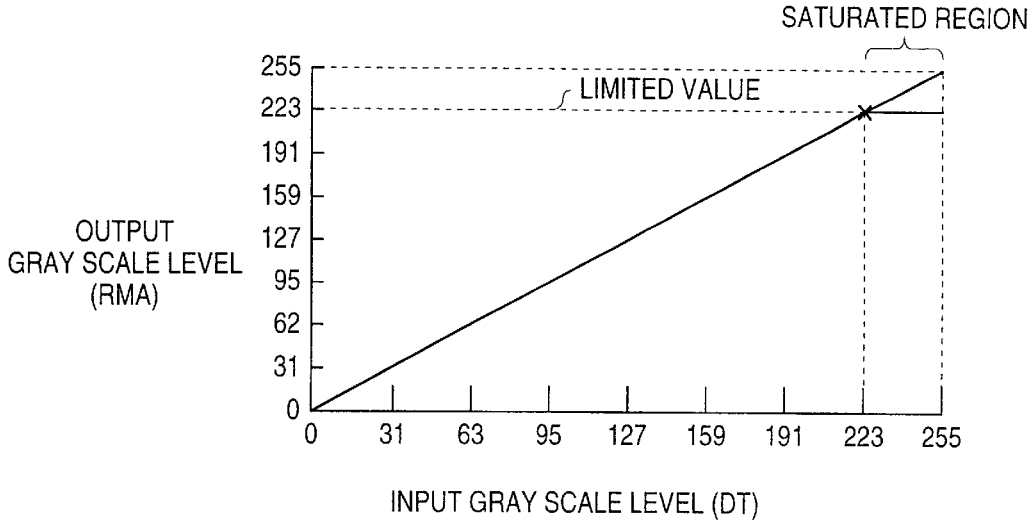
FIG. 18 is a graph showing the operational principle of a limiting circuit.

The reason for providing the limiting circuit 1321 will be explained while referring to FIGS. 18, 19 and 20. The operational principle of the limiting circuit 1321 is that the value of the signal RMA to be output is fixed to a limit value when the gray scale level of the input signal DT is higher than a predetermined level, as is shown in FIG. 18.

As is described above, according to the theory of the present invention, in order to reduce the memory capacity required for conversion tables, the signal is divided into the upper bit portion for which conversion is required and the lower bit portion for which conversion is not required. The upper bit portion is converted by using a conversion table and the result is synthesized with the un-converted lower bit portion, while the gray scale levels are matched. By this method, however, an inconvenience may occur, as is shown in FIG. 19.

In FIG. 19 is shown a case where gray scale levels 42, 43, 44 and 45 are converted directly by using conversion tables. DT7 through DT2 on the left are data before conversion and Q7 through Q1 on the right are data after conversion. According to the duplicated subframe method shown in FIG. 15, only gray scale levels 0 through 43 are targets for conversion. Upon receipt of gray scale level 44 as the input signal DT, the input signal DT becomes (101100), as is shown in FIG. 19. When the lower bits DT3 and DT2 of the input signal DT are synthesized unchanged with a converted bit portion, the output signal Q obtained is (1111100), and the sum of the gray scale levels after weighting is 40.

More specifically, the above described problem will occur when the number of gray scales (0 through 43 gray scale levels in the above example), which can be represented by the result obtained by the duplicated subframe conversion, is smaller than the number of gray scale levels (resolutions) (0 through 63 gray scales because of 6 bits in the above example), which can be represented by the input data DT. Therefore, the limit value must be altered in consonance with the setting of the duplicated subframe conversion tables.

To avoid such an inconvenience, in the present invention, when the gray scale level exceeds 43, the level is uniformly set to limit value 43. Thus, as is shown in a table in the middle of the chart in FIG. 20, the output RMA7 through RMA2 converted by the limiting circuit 1321 are fixed to gray scale level 43 with respect to gray scales 44 through 63, which exceed 43. When the duplicated subframe conversion is performed, as is shown in the table on the right in FIG. 20, all the gray scale levels over 43 are changed to gray scale level 43. When all the bits are converted, as in prior art, such a limiting operation must be performed for the conversion tables; however, in the present invention, since only one part of the bits is regarded as a conversion target, the above described limiting circuit is required.

Figures 21, 22, 28A, 28B, 28C:
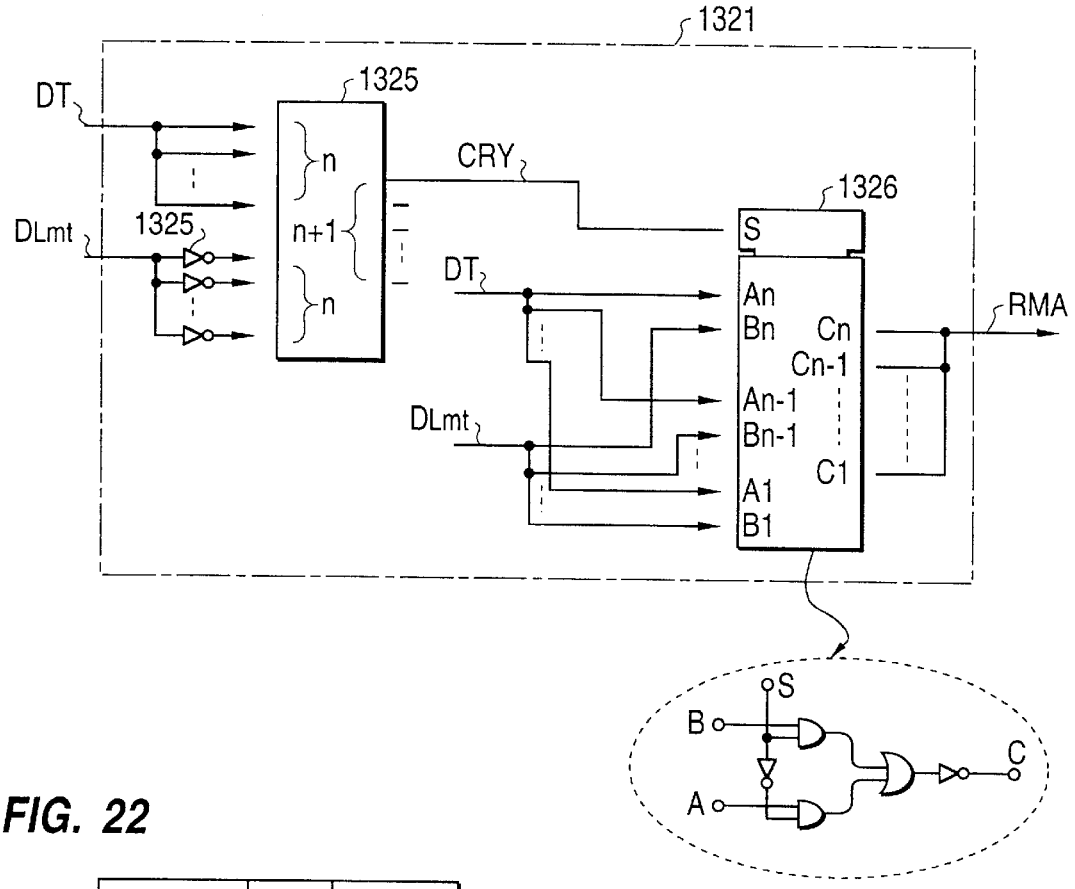
FIG. 21 is a diagram showing a specific example of the limiting circuit.
FIG. 22 is a diagram for explaining the operation of the limiting circuit.
FIGS. 28A, 28B and 28C are diagrams showing an example wherein conversion tables for a plurality of modes are employed.

FIG. 21 is a specific circuit diagram illustrating the limiting circuit 1321. A circuit 1325 compares the input data DT with a limit value DLMT set by the initialization ROM 137. Specifically, the circuit 1325 is an addition circuit that adds the input data DT to the inverted value of the limit value DLMT. As is shown in the diagram in FIG. 22, when the input data DT is greater than the limit value DLMT, a carry value CRY is 1; whereas when the input data DT is equal to or smaller than the limit value DLMT, the carry value CRY is 0. A selection circuit 1326 employs the carry value as a select signal S, and selects either the input data DT or the limit value DLMT. The selection circuit 1326 is constituted specifically by an AND circuit, an OR circuit, and an inverter, as is indicated the circuit fragment pointed at by the arrow.

In the RAM 1322, which is the look-up table for the conversion table section, the upper four bits out of the eight bits from the limiting circuit 1321 are input as multiple-level gray scale signals for conversion, i.e., address inputs RMA7 through RMA4. Further, in examples wherein six or eight sub-frames are employed, which will be described later, the upper four bits are regarded as targets for conversion. Data DDSF for the 8-bit duplicated subframe conversion table from the initialization ROM 137 are input to the RAM 1322, and the 8-bit RMD7 through RMD0 obtained after conversion are output from the RAM 1322. Data for a plurality of types of duplicated subframe conversion tables are stored in advance in the initialization ROM 137, so that an optimal conversion table can be written into the RAM 1322, as data DDSF, in consonance with the number of sub-frames to be used.

The address inputs RMA3 through RMA0 of the 8-bits output from the limiting circuit 1321 are transmitted to the shifting circuit 1323. The address inputs are shifted to the lower side in consonance with shift data DSFT (three bits) from the initialization ROM 137 indicating a shift value. Therefore, RMA 3 through RMA 0 are converted into S3 through S0, respectively.

Figures 23, 25:
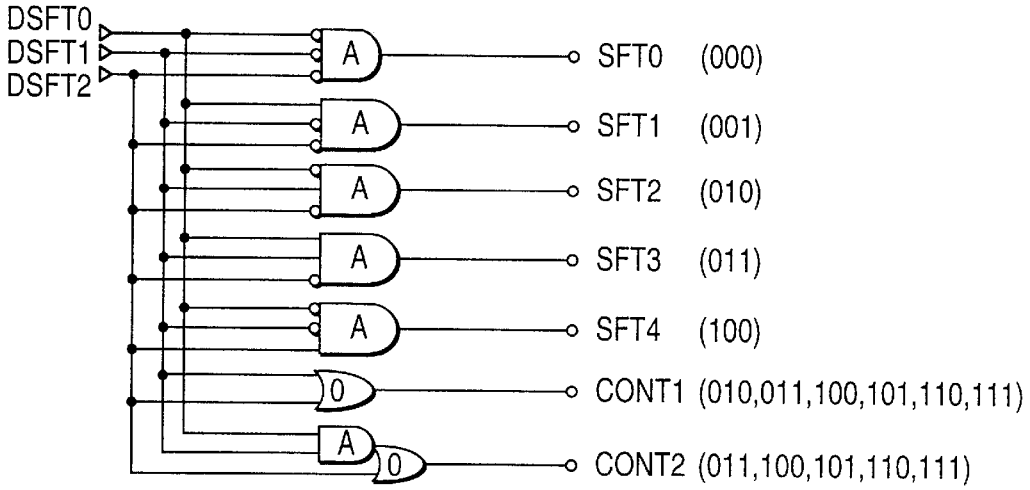
FIG. 23 is a table showing the relationship between the output of a shifting circuit and the output of a multiplexing circuit, and the number of shifts.
FIG. 25 is a diagram illustrating a control signal generation circuit in the circuit example shown in FIG. 24.

The data S3 through S0 obtained by shifting and the data RMD3 through RMD0 obtained after conversion are synthesized together by the multiplexing circuit 1324. This relationship will now be explained while referring to FIG. 23. FIG. 23 is a table showing the relationship between the outputs of the shifting circuit 1323 and the multiplexing circuit 1324, and a shift value of the shift data DSFT. When the shift value is 1, "0" and the signals RMA3 through RMA1 are output as the shifting outputs S3 through S0. When the shift value is 2, "0," "0," and the signals RMA3 and RMA2 are output as the shift outputs S3 though S0. The multiplexing circuit 1324 synthesizes the output data RMD obtained by converting these shift signals into bit portions corresponding to 0 (L level).

Figure 24:
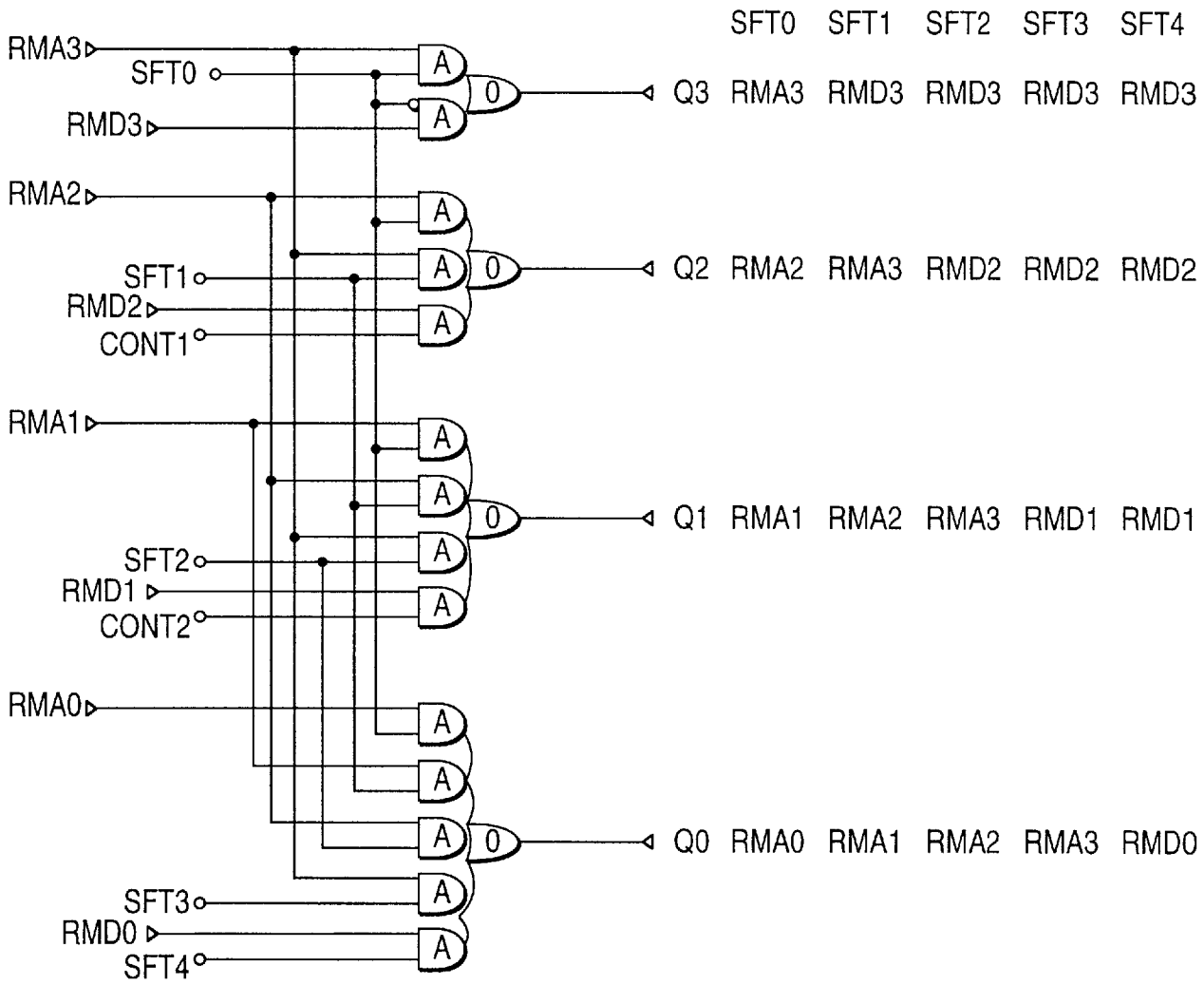
FIG. 24 is a diagram illustrating specific examples for the shifting circuit and the multiplexing circuit.

FIGS. 24 and 25 are specific diagrams illustrating a synthesizing section that realizes the functions of the shifting circuit 1323 and the multiplexing circuit 1324. In FIG. 24 is shown a synthesizing circuit that simultaneously provides the functions of both the shifting circuit 1323 and the multiplexing circuit 1324. The lower bits RMA3 through RMA0 output from the limiting circuit 1321, and the lower bits RMD3 through RMD0 output from the RAM 1322 are received together as input data. Further, shift control signals SFT0 through SFT4, and synthesizing control signals CONT1 and CONT2 from the control signal generation circuit in FIG. 25 are employed as control signals. The A in FIG. 24 denotes each AND circuit and the 0 denotes each OR circuit.

The control signal generation circuit in FIG. 25 produces, as control signals, the shift control signals SFT0 through SFT4 and the synthesizing control signals CONT1 and CONT2 based on the 3-bit shift data signals DSFT0 through DSFT2 supplied from the initialization ROM 137. The shift control signals SFT0 through SFT4 are signals acquired simply by decoding the 3-bit shift data signals DSFT0 through DSFT2, and correspond to the shift value. The synthesizing control signals CONT1 and CONT2 are signals having a value of 1 when the shift data signals have values, 010, 011, efc., shown in FIG. 25, and are generated by a logic circuit that is introduced by the condition for multiplexing.

Upon receipt of the thus generated shift control signals SFT0 through SFT4 and synthesizing signals CONT1 and CONT2, in the circuit shown in FIG. 24, the lower bit data RMA3 through RMA0 of the limiting circuit 1321 are shifted in consonance with the shift value, and the resultant data are synthesized with the lower bit outputs RMD3 through RMD0 from the RAM 1322, as is shown on the right side in FIG. 24. The results obtained are the same as those in the table in FIG. 23.

When, for example, the shift value in the conversion table in FIG. 15 is 1, the shift control signal SFT1 is 1 and the other signals SFT0, SFT2, SFT3, SFT4 are 0. Thus, the RMD3 is output as Q3; the RMA3 is output as Q2; the RMA2 is output as Q1; and the RMA1 is output as Q0.

In the above described manner, the data Q7 through Q0, corresponding to sub-frames obtained after conversion by the duplicated subframe conversion section 132, are supplied to the data array conversion section 133. In response to an instruction signal from the initialization ROM 137, the data conversion section 133 adapts the valid output, Q7 through Q1 in the above example, and disregards the output Q0.

Figure 26:
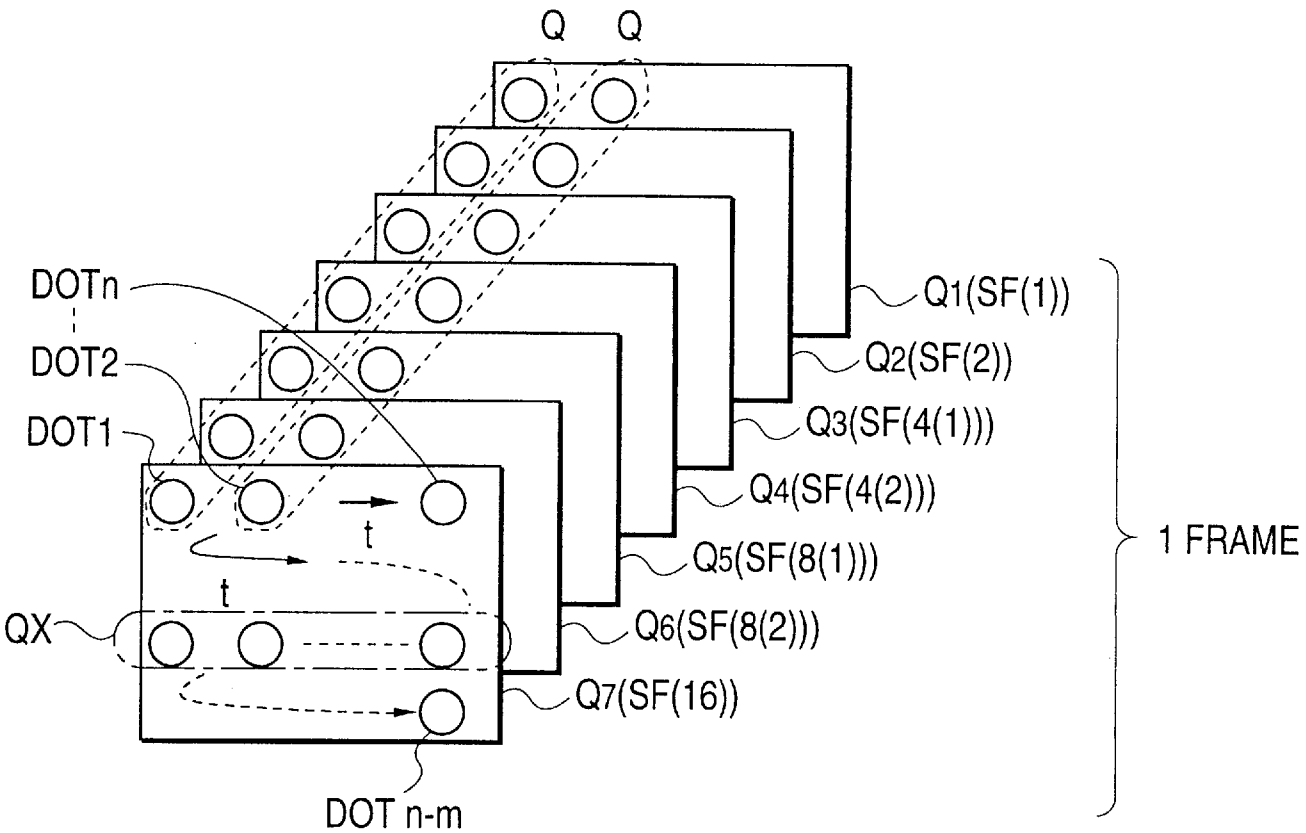
FIG. 26 is a diagram for explaining the operation principle of a data array conversion section.

Since the data array conversion section 133 is not directly related to the present invention, only a brief explanation will be given. FIG. 26 is a diagram for explaining the operational principle of the data array conversion section 133. The input display data are input in the order represented by the pixels to be displayed on a screen, as is shown along time t. The duplicated subframe conversion is performed on RGB signals for each of the pixels DOT1, . . ., DOTn, . . ., and DOTnm, so as to produce the outputs Q7 through Q1. On an actual display panel, however, the address data driver 6 drives an address electrode for each line on a screen according to the address data.

The data array conversion section 133, therefore, stores in the frame memory 134 data QX, for each sub-frame, that is at least collected for each scanning line. From the frame memory 134, address data A-DATA for each line is output in the order for displaying sub-frames shown in FIG. 15 (the order Q3, Q5, Q2, Q7, Q1, Q6 and Q4).

[Another embodiment]

In FIG. 27 is shown another example of a weighting conversion table employed for a combination of seven sub-frames. While the weighting conversion table for seven sub-frames is shown also in FIG. 15, the conversion table in FIG. 27 has a different conversion from that in the table in FIG. 15, even though the same number of sub-frames are used. More specifically, with the table in the case shown in FIG. 15, when the luminance level is 4 or 8, the sub-frames are lit as early as possible in a frame period. On the other hand, in the case shown in FIG. 27, when the luminance level is 4 or 8, the sub-frames are lit as late as possible in the frame period. Since the sub-frames to be lit are dispersed in either case, the problems of flicker and false color contours can be resolved. These different conversion tables are selectively used in consonance with the position of a pixel, and picture quality can be enhanced.

It is, therefore, preferable that conversion tables in a plurality of modes be prepared as above described, and as is shown in FIG. 28, the mode of a conversion table to be used be altered in consonance with the location of a pixel. In FIG. 28A is shown an example wherein mode A and mode B are located in a zigzag pattern. In FIG. 28B is shown an example wherein mode A and mode B are located in a zigzag pattern as units of four pixels each. And in FIG. 28C is an example wherein a conversion table corresponding to four modes, A, B, C and D, is employed and each mode is shifted by one pixel for each line.

A duplicated subframe conversion section 132 when it employs conversion tables in a plurality of modes will now be described while referring back to FIG. 17. To employ conversion tables having a plurality of modes, conversion tables equivalent in number to the number of modes must be stored in the RAM 1322. A mode signal MODE is input as an upper input address to the initialization ROM 137 and the RAM 1322. When the number of modes is 2, the mode signal MODE has one bit. When the number of modes is 4, the mode signal MODE has two bits.

First, a plurality of conversion tables to be employed are extracted from the initialization ROM 137 and are stored in the RAM 1322. During a display, the interface control circuit 136 shown in FIG. 14 identifies the current pixel position by referring to the vertical synchronization signal Vsync, the horizontal synchronization signal Hsync and the clock signal CLK, and transmits to the RAM 1322 the mode signal MODE indicating which mode conversion table is to be used. In this manner, the selection of the mode is performed by units of one pixel each.

In the above embodiment, the conversion of 6-bit multiple-level gray scale output into seven sub-frames was explained. The circuit arrangement in the duplicated subframe conversion section shown in FIG. 17 can be employed to convert the multiple-level gray scale output having bit counts other than six into different numbers of sub-frames. In other words, each conversion table is stored in the initialization ROM 137, and an optimal conversion table is selected in consonance with the ability of a flat display panel to be employed. Such a wide use of conversion tables will now be described.

FIG. 29 is a table showing the relationship between bits for duplicated subframe conversion. In the table are entered the input address RMA of the RAM 1322, the output RMD of the RAM 1322, the shift value, the number of sub-frames (SF), and finally, the valid duplicated subframe conversion outputs for each case of multiple-level gray scale outputs of 4 through 7 bits.

The conversion tables in FIGS. 15 and 27 are employed to convert the 6-bit multiple-level gray scale output into seven sub-frames. Thus, as is shown in the table in FIG. 29, the upper four bits are employed as the input address for the RAM 1322. The converted five-bit RAM output is synthesized with the 2-bit signal obtained by a shift of one, and the 7-bit duplicated subframe conversion output corresponding to the seven sub-frames is thus acquired.

In FIGS. 11 and 30 are shown examples for converting 6-bit multiple-level gray scale output into eight sub-frames. The conversion table provides two modes as is explained while referring to FIGS. 15 and 27. As is shown in the table in FIG. 29, the upper four bits are used as the input address for the RAM 1322. The 6-bit RAM output obtained after conversion is synthesized with a 2-bit signal obtained by a shift of two, and thus 8-bit duplicated subframe conversion output corresponding to eight sub-frames is acquired.

FIGS. 33 and 34 are shown examples for converting 5-bit multiple-level gray scale output into six sub-frames. The conversion table provides two modes, as is explained while referring to FIGS. 15 and 27. As is shown in the table in FIG. 29, the upper four bits are used as the input address for the RAM 1322. The 5-bit RAM output obtained after conversion is synthesized with a 1-bit signal obtained by a shift of one, and thus 6-bit duplicated subframe conversion output corresponding to six sub-frames is acquired.

Theoretically, only the upper three bits of the 5-bit multiple-level gray scale output can be employed as an input address for the RAM 1322, and the lower two bits can be regarded as other than targets for conversion. In this case, the circuit arrangement of the duplicated subframe conversion section 32 shown in FIG. 17 needs to be changed to a degree. However, since the required capacity of the RAM does not differ very much for the acquisition of a 4-bit output relative to a 3-bit input, and for the acquisition of a 5-bit output relative to a 4-bit input, in order to obtain wide use, the upper four bits are regarded as a conversion target as is described above.

As is apparent from the above examples, when a multiple-level gray scale signal is an M-bit signal (M is an integer of 2 or greater), arbitrary N bits (N is an integer of 1 or greater and M>N) of the multiple-level gray scale signal is employed as a memory address signal in conversion tables, the duplicated subframe conversion output is P bits (P is equal to or grater than N), a multiple-level gray scale signal of remaining M-N bits is shifted a distance equivalent to P-N bits, and the resultant signal is synthesized with the duplicated subframe conversion output.

As is described above, according to the present invention, even when display data is supplied by a vertical synchronization signal of a higher frequency, which is accompanied with the multi-scanning of a system, an optimal number of sub-frames can be selected in consonance with the signal frequency, and a portion required for display control can be changed as needed. The display data having a vertical synchronization signal of a different frequency, or a higher frequency, can be displayed on a screen without deterioration of picture quality.

Further, according to the present invention, savings in the memory capacity required for storing conversion table data employed for duplicated subframe conversion can be realized. Therefore, data for a plurality of conversion tables can be stored in memory without an increase in the memory capacity, and picture quality can be further enhanced.

In addition, by saving on the required memory capacity, the characteristic of a flat panel display device, i.e., size reduction, is not lost, and at the same time, picture quality can be improved.

What we claim are:

1. A display device for time division multiple-level gray scale picture display, comprising:

a sub-frame selection circuit that receives a vertical synchronization signal, selects a value indicating a number of sub-frames to be displayed within a period for a frame of an input display data signal in accordance with a frequency of the vertical synchronization signal, and provides a sub-frame selection signal corresponding to the selected value; and a display control circuit, coupled to said sub-frame selection circuit, that receives the sub-frame selection signal and the input display data signal and controls display of a multi-level gray scale picture in accordance with the selected value.

2. A display device according to claim 1, wherein:

said display control circuit includes a sub-frame counter for outputting an identifying number for a sub-frame being displayed;

an initial value corresponding to the selected value is loaded to the sub-frame counter; and said display control circuit controls the display of the multi-level gray scale picture in accordance with the identifying number of the sub-frame being displayed.

3. A display device according to claim 1 wherein:

the input display data signal corresponds to a predetermined first number of bits representing an input gray scale thereof; and said display control circuit includes a pseudo-multiple-level gray scale conversion circuit that receives the input display data signal, converts the input display data signal into a pseudo-multiple-level gray scale data signal corresponding to a second number of bits less than the first number of bits, the second number of bits being selectively set in accordance with the selected value.

4. A display device according to claim 1 wherein:

each sub-frame comprises:

an address period for lightening a cell region corresponding to a pixel to be lightened according to the input display data signal, and a sustain period in which a number of sustain pulses are supplied to the lightened cell region to provide a sustain pulse time, the number of sustain pulses corresponding to a weight value of brightness for the sub-frame;

the display control circuit includes a sustain time setting circuit that determines the sustain pulse times of the respective sub-frames according to the selected value and outputs the sustain pulse times; and said display control circuit provides the number of sustain pulses according to the sustain pulse time of the sub-frame.

5. A display device according to claim 1 wherein said display control circuit includes a display data conversion circuit that:

receives the input display data signal;

stores a plurality of conversion tables, each conversion table providing a relation between respective brightnesses of the input display data signal and data for a corresponding number of sub-frames to be displayed in each frame; and converts the input display data signal into a display data signal, representing the number of sub-frames indicated by the selected value, by reference to a conversion table selected from the plurality of conversion tables according to the selected value.

6. A display device according to claim 1 wherein:

the input display data signal corresponds to a predetermined first number of bits representing an input gray scale thereof;

each sub-frame comprises:

an address period for lightening a cell region corresponding to a pixel to be lightened according to the input display data signal, and a sustain period in which a number of sustain pulses are supplied to the lightened cell region, the number of sustain pulses corresponding to a weight value of brightness for the sub-frame; and said display control circuit comprises:

a pseudo-multiple-level gray scale conversion circuit that receives the input display data signal, converts the input display data signal into a pseudo-multiple-level gray scale data signal corresponding to a second number of bits lower than the first number of the bits, the second number of bits being selectively set in accordance with the selected value;

a display data conversion circuit, coupled to the pseudo-multiple-level gray scale conversion circuit, that:

receives the pseudo-multiple-level gray scale data signal;

stores a plurality of conversion tables, each conversion table providing a relation between respective brightnesses indicated by the pseudo-multiple-level gray scale data signal and data for a corresponding number of sub-frames to be displayed in each frame; and converts the pseudo-multiple-level gray scale data signal into a display data signal by reference to a selected conversion table, the display data signal representing data for the number of the sub-frames indicated by the selected value, the selected conversion table being selected from the plurality of conversion tables according to the selected value;

a sustain time setting circuit that determines a sustain pulse time for each of the selected number of the sub-frames in accordance with the selected value; and a display panel driving controller, coupled to the sustain time setting circuit, that provides a sustain pulse in accordance with each of the sustain pulse times.

7. A display device according to claim 6, wherein the second number of bits is selectively set according to the selected value and the selected conversion table when the display data signal corresponds to a number of bits larger than the second number of bits.

8. A method of driving a display device for time division multiple-level gray scale picture display, comprising the steps of:

selecting a value indicating a number of sub-frames to be displayed within a period of a frame of an input display data signal in accordance with a frequency of a vertical synchronization signal;

providing a sub-frame selection signal corresponding to the selected value; and controlling display of a multi-level gray scale picture in accordance with the selected value.

9. A display device for time division multiple-level gray scale picture display, comprising:

a conversion table section that stores a first conversion table, receives an address signal formed by a specified number of upper bits of a multiple-level gray scale signal having a first plurality of bits corresponding to a first plural level gray scale, and converts the address signal through the first conversion table to output a duplicated sub-frame conversion signal having a second plurality of bits corresponding to a second plural level gray scale and having a predetermined plurality of sub-frames for each frame of the multiple-level gray scale signal;

a synthesizer, coupled to said conversion table section, that synthesizes a remaining number of lower bits of the multiple-level gray scale signal with a number of lower bits of the duplicated sub-frame conversion signal according to the second plural level gray scale to produce a plural-subframes signal for a frame of the multiple-level gray scale signal; and a display control circuit, coupled to said synthesizer, that displays a multiple-level gray scale picture on a display according to the plural-subframes signal.

10. A display device according to claim 9, wherein the predetermined plurality of subframes of the duplicated sub-frame conversion signal includes a plurality of sub-frames having a uniform gray scale weight value.

11. A display device according to claim 9, wherein:

said synthesizer shifts the remaining number of lower bits by a specified shift bit number of bits when the second plurality of bits is larger than the first plurality of bits.

12. A display device according to claim 9, further comprising:

a limit circuit, coupled to said conversion table section at a front stage thereof, that limits a gray scale level of the multiple-level gray scale signal to a level not higher than a specified gray scale level when the gray scale level of the multiple-level gray scale signal is higher than a maximum gray scale level of the plural-subframes signal, the specified gray scale level being defined by the maximum gray scale level.

13. A display device according to claim 9, wherein:

said conversion table section stores a second conversion table, the first and second conversion tables respectively corresponding to first and second modes for conversion, and receives a mode signal designating a selected mode; and said display control circuit supplies the selected mode signal to said conversion table section depending on a position of a pixel to be displayed.

14. A display device according to claim 9, wherein said conversion table section includes a memory, said display device further comprising an initial memory that stores data corresponding to a plurality of conversion tables, the data of at least one of the conversion tables being written in the memory of said conversion table section.

15. A display device according to claim 11, further comprising an initial memory for storing data corresponding to a plurality of conversion tables, and wherein:

said conversion table section includes a memory;

the data of at least one of the conversion tables is written in the memory of said conversion table section; and said initial memory provides said synthesizer with a shift data signal indicating a shift bit number in accordance with the conversion table written in the memory of said conversion table section.

16. A display device according to claim 12, further comprising an initial memory for storing data corresponding to a plurality of conversion tables, and wherein:

said conversion table section includes a memory;

the data of at least one of the conversion tables is written in the memory of said conversion table section; and said initial memory provides said limit circuit with a limit value signal indicating the specified gray scale level in accordance with the memory of said conversion table written in the conversion table section.

17. A display device for time division multiple-level gray scale picture display, comprising:

a conversion table section that stores a conversion table, receives an address signal formed by a specified number of upper bits of a multiple-level gray scale signal having a first plurality of bits corresponding to a first plural level gray scale, and converts the address signal through the conversion table to output a duplicated sub-frame conversion signal having a second plurality of bits corresponding to a second plural-level gray scale and having a predetermined plurality of sub-frames for each frame of the multiple-level gray scale signal, the predetermined plurality of sub-frames including a plurality of sub-frames having a uniform gray scale weight value;

a synthesizer, coupled to said conversion table section, that shifts a remaining number of lower bits of the multiple-level gray scale signal by a specified shift bit number of bits when the second plurality of bits is larger than the first plurality of bits, and synthesizes the shifted remaining number of lower bits with a number of lower bits of the duplicated sub-frame conversion signal according to the gray scale of the second plurality of bits, to produce a plural-subframes signal for a frame of the multiple-level gray scale signal;

a limit circuit coupled to said conversion table section at a front stage thereof, that limits a gray scale level of the multiple-level gray scale signal to a level not higher than a specified gray scale level when the gray scale level of the multiple-level gray scale signal is higher than a maximum gray scale level of the plural-subframes signal, the specified gray scale level being defined by the maximum gray scale level; and a display control circuit, coupled to said synthesizer, that displays a multiple-level gray scale picture on a display according to the plural-subframes signal.

18. A display device according to claim 17, wherein:

the first plurality of bits consists of 5 bits;

the specified number of upper bits includes a most significant 4 bits of the multiple-level gray scale signal;

the second plurality of bits consists of 5 bits;

the remaining number of lower bits includes a least significant 1 bit of the multiple-level gray scale signal; and the least significant 1 bit of the multiple-level gray scale is shifted by 1 bit and synthesized with the number of lower bits of the duplicated sub-frame conversion signal.

19. A display device according to claim 17, wherein:

the first plurality of bits consists of 5 bits;

the specified number of upper bits includes a most significant 4 bits of the multiple-level gray scale signal;

the second plurality of bits consists of 6 bits;

the remaining number of lower bits includes a least significant 1 bit of the multiple-level gray scale signal; and the least significant 1 bit of the multiple-level gray scale is shifted by 2 bits and synthesized with the number of lower bits of the duplicated sub-frame conversion signal.

20. A display device according to claim 17, wherein:

the first plurality of bits consists of 5 bits;

the specified number of upper bits includes a most significant 4 bits of the multiple-level gray scale signal;

the second plurality of bits consists of 7 bits;

the remaining number of lower bits includes a least significant 1 bit of the multiple-level gray scale signal; and the least significant 1 bit of the multiple level gray scale is shifted by 3 bits and synthesized with the number of lower bits of the duplicated sub-frame conversion signal.

21. A display device according to claim 17, wherein:

the first plurality of bits consists of 6 bits;

the specified number of upper bits includes a most significant 4 bits of the multiple-level gray scale signal;

the second plurality of bits consists of 5 bits;

the remaining number of lower bits includes a least significant 2 bits of the multiple-level gray scale signal; and the least significant 2 bits of the multiple-level gray sale are shifted by 1 bit and synthesized with the number of lower bits of the duplicated sub-frame conversion signal.

22. A display device according to claim 17, wherein:

the first plurality of bits consists of 6 bits;

the specified number of upper bits includes a most significant 4 bits of the multiple-level gray scale signal;

the second plurality of bits consists of 6 bits;

the remaining number of lower bits includes a least significant 2 bits of the multiple-level gray scale signal; and the least significant 2 bits of the multiple-level gray scale are shifted by 2 bits and synthesized with the number of lower bits of the duplicated sub-frame conversion signal.

23. A display device according to claim 17, wherein:

the first plurality of bits consists of 7 bits;

the specified number of upper bits includes a most significant 4 bits of the multiple-level gray scale signal;

the second plurality of bits consists of 5 bits;

the remaining number of lower bits includes a least significant 3 bits of the multiple-level gray scale signal; and the least significant 3 bits of the multiple-level gray scale signal are shifted by 1 bit and synthesized with the number of lower bits of the duplicated sub-frame conversion signal.

24. A display device according to claim 17, wherein:

the first plurality of bits consists of M bits, where M is an integer equal to or larger than 2;

the specified number of upper bits includes a most significant N bits of the multiple level gray scale signal, where N is an integer less than M but equal to or larger than 1;

the second plurality of bits consists of P bits, where P is an integer equal to or larger than N;

the remaining number of lower bits includes a least significant M-N bits of the multiple-level gray scale signal; and the least significant M-N bits of the multiple-level gray scale signal are shifted by P-N bits and synthesized with the number of lower bits of the duplicated sub-frame conversion signal.

25. A method of time division multiple-level gray scale picture display, comprising the steps of:

receiving an address signal formed by a specified number of upper bits of a multiple-level gray scale signal having a first plurality of bits corresponding to a first plural-level gray scale;

converting the address signal using a conversion table to output a duplicated sub-frame conversion signal having a second plurality of bits corresponding to a second plural-level gray scale, and having a predetermined plurality of sub-frames for each frame of the multiple-level gray scale signal;

synthesizing a remaining number of bits of the multiple-level gray scale signal with a number of lower bits of the duplicated sub-frame conversion signal according to the second plural-level gray scale to produce a plural-subframes signal for a frame of the multiple-level gray scale signal; and displaying a multiple-level gray scale picture on a display according to the plural-subframes signal.

* * * * *